US009114636B2

(12) United States Patent
Häcker et al.

(10) Patent No.: US 9,114,636 B2
(45) Date of Patent: Aug. 25, 2015

(54) PRINTING MACHINE AND METHOD FOR ADJUSTING A WEB TENSION

(75) Inventors: Christoph Alban Häcker, Karlstadt (DE); Frank Eberhard Huppmann, Zell am Main (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 14/118,697

(22) PCT Filed: May 2, 2012

(86) PCT No.: PCT/EP2012/057979

§ 371 (c)(1),
(2), (4) Date: Nov. 19, 2013

(87) PCT Pub. No.: WO2012/163614

PCT Pub. Date: Dec. 6, 2012

(65) Prior Publication Data

US 2014/0104360 A1 Apr. 17, 2014

(30) Foreign Application Priority Data

Jun. 1, 2011 (DE) ..... 10 2011 076 899
Dec. 16, 2011 (DE) ..... 10 2011 088 776

(51) Int. Cl.
*B41J 2/01* (2006.01)
*B41J 11/00* (2006.01)
(Continued)

(52) U.S. Cl.
CPC ..... *B41J 11/0015* (2013.01); *B41J 3/60* (2013.01); *B41J 11/002* (2013.01); *B41J 15/16* (2013.01); *B41J 15/165* (2013.01)

(58) Field of Classification Search
CPC ..... B41J 15/16; B41J 15/165; B65H 77/00
See application file for complete search history.

(56) References Cited

U.S. PATENT DOCUMENTS 5,579,115 A * 11/1996 Stein et al. ..... 358/296
6,499,639 B2 * 12/2002 Cote et al. ..... 226/42
(Continued)

FOREIGN PATENT DOCUMENTS

EP 1 155 987 B1 11/2001
EP 2 161 136 A2 3/2010
(Continued)

*Primary Examiner* — Shelby Fidler
*Assistant Examiner* — Tracey McMillion
(74) *Attorney, Agent, or Firm* — Mattingly & Malur, PC

(57) ABSTRACT

The invention relates to a printing machine having at least one printer unit comprising at least one inkjet printhead, a central printing cylinder, and a drive motor of its own dedicated to the central printing cylinder. A conveying path of a printing material web through the printing machine has at least one first section and one second section, each defined by contact points of the printing material, which have motor-powered rotation bodies. At least the first section has a dedicated first measuring device for measuring a web tension of the printing material web in the first section. At least the second section has a dedicated second measuring device for measuring the web tension of the printing material web in the second section. A machine controller is arranged, by means of which the web tension in at least the first section and/or in the second section of the conveying path of the printing material web can be adjusted and/or is adjusted, taking into consideration at least both a measuring result from the first measuring device and a measuring result from the second measuring device. The invention further relates to a method for adjusting a web tension of a printing material web.

8 Claims, 9 Drawing Sheets

(51) Int. Cl.
*B41J 3/60* (2006.01)
*B41J 15/16* (2006.01)

(56) References Cited

U.S. PATENT DOCUMENTS

| | | | | |
|---|---|---|---|---|
| 7,739,952 | B2 * | 6/2010 | Sakamoto | 101/484 |
| 8,430,503 | B2 | 4/2013 | Fukui | |
| 2002/0008173 | A1 | 1/2002 | Burri et al. | |
| 2002/0166470 | A1 | 11/2002 | Nedblake, Jr. et al. | |
| 2004/0144272 | A1 * | 7/2004 | Kolbe et al. | 101/228 |
| 2006/0125899 | A1 * | 6/2006 | Cornish et al. | 347/104 |
| 2007/0051264 | A1 * | 3/2007 | Sakamoto | 101/484 |
| 2008/0094443 | A1 | 4/2008 | Miyazaki | |
| 2010/0188468 | A1 | 7/2010 | Herpel et al. | |
| 2011/0063389 | A1 | 3/2011 | Hanson et al. | |

FOREIGN PATENT DOCUMENTS

| | | | |
|---|---|---|---|
| EP | 2 202 081 | A1 | 6/2010 |
| JP | 2003-063707 | A | 3/2003 |

* cited by examiner

PRINTING MACHINE AND METHOD FOR ADJUSTING A WEB TENSION

CROSS REFERENCE TO RELATED APPLICATIONS

This application is the U.S. national phase, under 35 USC 371, of PCT/EP2012/057979, filed May 2, 2012, published as WO2012/163614 A1 on Dec. 6, 2012, and claiming priority to DE 10 2011 076 899.8, filed Jun. 1, 2011 and to DE 10 2011 088 776.8, filed Dec. 16, 2011, the disclosures of which are expressly incorporated herein by reference.

FIELD OF THE INVENTION

The invention relates to a printing machine and to a method for adjusting a web tension.

BACKGROUND OF THE INVENTION

Various printing methods that can be used in rotary printing machines are known. One such printing method is inkjet printing. In this method, individual droplets of printing ink are ejected from nozzles in print heads and transferred to a printing material so as to produce a printed image on the printing material. By controlling a plurality of nozzles individually, different printed images can be produced. No set printing forme is used, thus each individual printed product can be designed separately. This allows personalized printed products to be produced and/or, since no printing forms are used, allows small print runs of printed products to be produced at low cost.

The precise alignment of a printed image on the front and back sides of printing material imprinted on both sides is referred to as register (DIN 16500-2). In multicolor printing, when individual printed images of different colors are combined in precise alignment to form a single image, this is referred to as color registration (DIN 16500-2). In inkjet printing, suitable measures must also be implemented to maintain color registration and/or register.

From EP 2 202 081 A1 and from JP 2003-063737 A, printing machines are known, in which the printing machine comprises a first printing unit and a dryer, the first printing unit having a central cylinder with an integral drive motor dedicated to the first central cylinder, and at least one inkjet print head, which is aligned toward an outer cylinder surface of the first central cylinder.

From EP 1 155 987 B1, a roll unwinding device for a web-fed rotary printing machine is known, wherein the roll unwinding device has at least one roll holding device and at least one drive motor, connected to the at least one roll holding device via at least one torque transfer device, and wherein the roll unwinding device has at least one common support or support frame, which has two supporting arms and/or on which two supporting arms are disposed, and which is arranged so as to pivot about a pivot axis relative to a stationary frame of the roll unwinding device.

From US 2008/094443 A1 a printing machine is known which comprises at least one first printing unit, wherein the at least one first printing unit has at least one inkjet print head, at least one first central printing cylinder and an integral first drive motor, dedicated to the at least one first central printing cylinder, and wherein a transport path of a printing material web through the printing machine has at least one first section and one second section, each of which is delimited by contact points of the printing material web with motor-driven rotating bodies, and wherein at least the first section has at least one first dedicated measuring device for measuring a web tension of the printing material web in the first section, and wherein at least the second section has at least one second dedicated measuring device for measuring the web tension of the printing material web in the second section.

From US 2002/166470 A1, a printing machine is known which comprises at least one first printing unit, wherein the at least one first printing unit has at least one inkjet print head, at least one first central printing cylinder and an integral first drive motor, dedicated to the at least one first central printing cylinder, and wherein a transport path of a printing material web through the printing machine has at least one first section and one second section, each of which is delimited by contact points of the printing material web with motor-driven rotating bodies.

From EP 2 161 136 A1, a printing machine is known, said printing machine having at least one first printing unit, wherein the at least one first printing unit has at least one inkjet print head. Only a single section of a printing material which is delimited by contact points of the printing material web with motor-driven rotating bodies is specified. The optionally specified measuring devices on transport rolls are all located within this section.

From US 2011/063389 A1, a printing machine having a first printing unit, an inkjet print head is known, wherein a transport path of a printing material web through the printing machine has at least one first section and one second section, each of which is delimited by contact points of the printing material web with motor-driven rotating bodies.

It is also known to employ the inkjet printing method for imprinting textile printing materials. Textile printing materials in this context are understood particularly as those materials that are listed in DIN 60000 (January 1969). In contrast to printing materials such as paper or metal, textile printing materials are relatively unstable in shape. For instance, textile materials frequently are more or less stretchable, wherein when the material is stretched in one direction, it usually contracts in another direction, for example, oriented orthogonally to the first direction. For this reason, to ensure a true-to-register imprinting of textile printing materials, not only must the printing material be properly positioned, a stable shape of the printing material must also be maintained at least during the printing process.

SUMMARY OF THE INVENTION

The object of the invention is that of providing a printing machine and a method for adjusting a web tension.

The object is attained according to the invention by the provision of a printing machine that has at least one first printing unit which has at least one inkjet print head and at least one first central printing cylinder. An integral first drive motor is dedicated to the at least one first central printing cylinder. A transport path of a printing material web through the printing machine has at least one first section and at least one second section, each of which is delimited by contact points of the printing material web with motor-driven rotating bodies. At least the first section has at least one first dedicated measuring device measuring a web tension of the printing material web in the first section. The at least one second section has at least one second dedicated measuring device measuring the web tension of the printing material web in the second section. A machine controller is provided and is usable to adjust the web tension, at least in the first section of the transport path, of the printing material web. The adjustment takes into consideration both at least one measurement value from the at least one first measuring device and at least one measurement value from the at least one second measuring device. The machine controller is also usable to adjust the web tension at least in the second section of the transport path of the printing material web, again taking into consideration the at least one measurement value from the first measuring device and the at least one measurement value from the at least one second measuring device. The first section and the second section can be delimited by the at least one first central printing cylinder.

The advantages to be achieved by the invention consist particularly in enabling a highly effective adjustment of a web tension of the printing material web. This is accomplished, for example, by means of a preferred multiplicity of driven rotating bodies and/or corresponding impression rollers which are in contact with said bodies and/or preferably a series of measuring devices embodied as measuring rollers. In addition to avoiding web breaks and/or sagging, this preferable adjustment of web tension serves to improve color registration and/or register, since stretching of the printing material web is directly dependent on forces acting on the printing material web. A further advantage is that usable printed products can be produced from the start of a printing operation, because the at least one print head preferably ejects printing ink at all transport speeds of the printing material web 02, and preferably ejects it at all accelerations of the transport speed of the printing material web 02, particularly negative and/or positive accelerations. This is enabled particularly by the precise adjustment of web tension. A savings of time and material is thereby realized, since less paper spoilage and/or less unprinted printing material 02 is produced.

A further advantage results from the preferred arrangement of at least two web edge aligners, which enable an especially precise conveyance of a printing material web, resulting in a particularly high quality printed product.

A further advantage is that, through a suitable arrangement of the at least one central cylinder and/or preferably at least one dryer and/or preferably one roll unwinding device, a compact configuration can be achieved. More particularly, with a preferred arrangement of corresponding dryer and optionally cooling units, drying of a printing material and particularly a printing material web over short transport paths can be ensured. Using short transport paths allows difficulties with color registration and/or register to be avoided and the quantity of paper wastage minimized. Moreover, this facilitates an adjustment of web tension. Corresponding arrangements of printing units and dryers allow any smearing of already imprinted printed images to be avoided. A preferred arrangement of one dryer unit having two dryers improves accessibility to printing units and dryers and ensures an optimized transport path of the printing material, particularly of the printing material web. A preferred use of at least one radiation dryer improves energy efficiency, particularly in the case of an infrared radiation dryer. This effect is preferably enhanced by a combination of radiation dryer and air flow dryer. Additionally, at least one ventilating device is preferably provided on the at least one dryer. A preferably symmetrical configuration with respect to the central cylinder and the dryer enables a modular construction, in which a simple reversal of direction of the printing machine by means of fewer guide rollers is possible.

BRIEF DESCRIPTION OF THE DRAWINGS

Embodiment examples of the invention are illustrated in the set of drawings and will be specified in greater detail in the following.

The drawings show.

DESCRIPTION OF PREFERRED EMBODIMENTS

Figure 1:
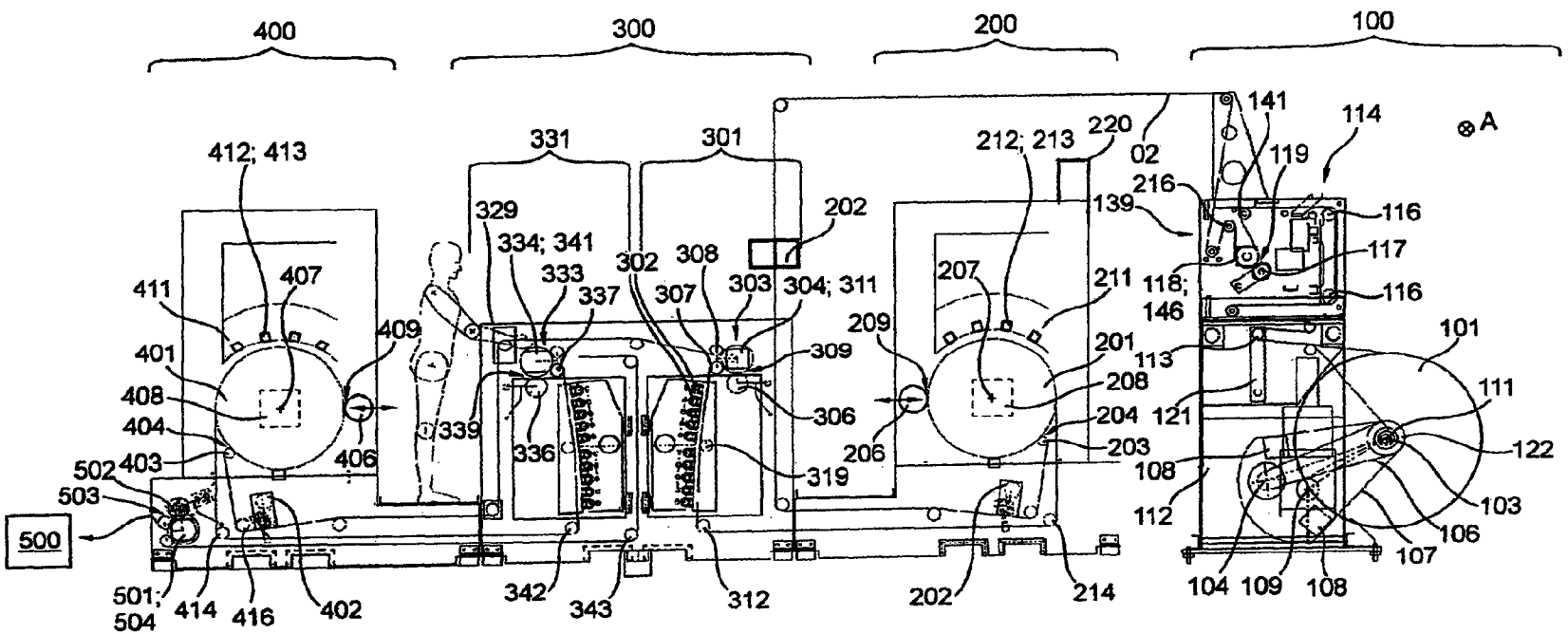
FIG. 1 a schematic illustration of a web-fed printing machine.
Figure 2:
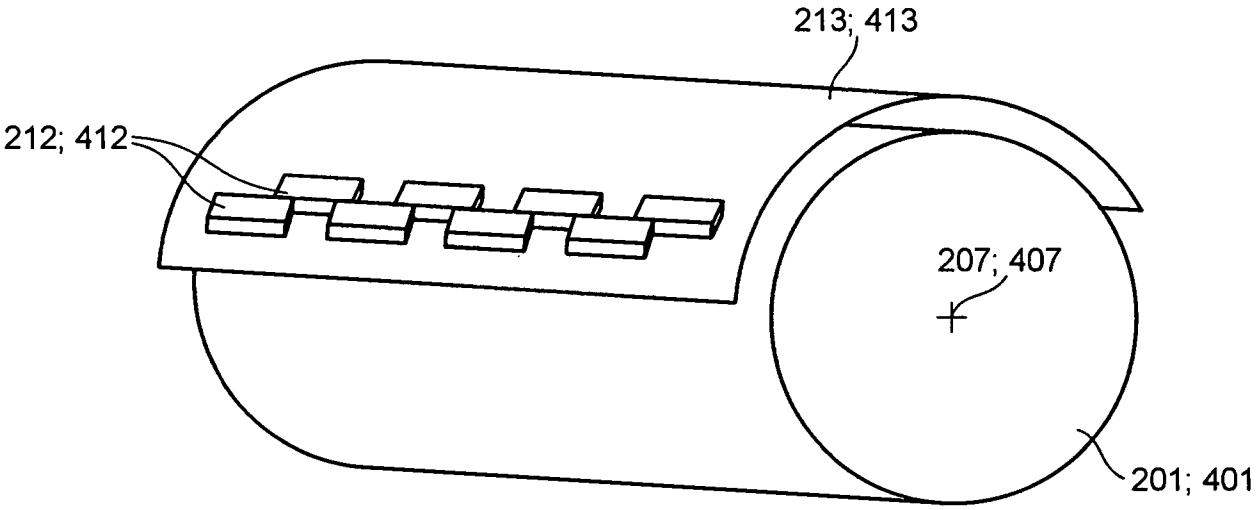
FIG. 2 a schematic illustration of part of a printing unit having a double row of print heads.
Figure 3:
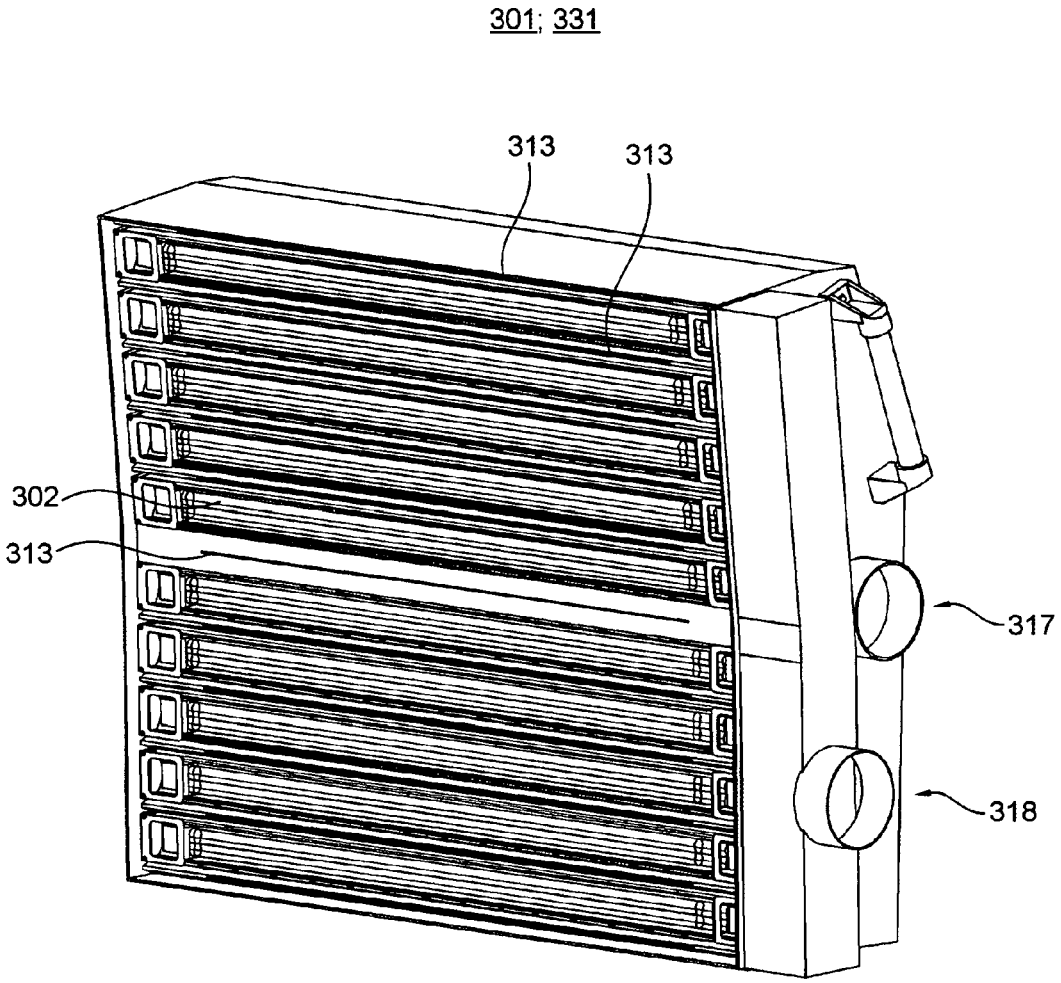
FIG. 3 a schematic illustration of part of a dryer.
Figure 4:
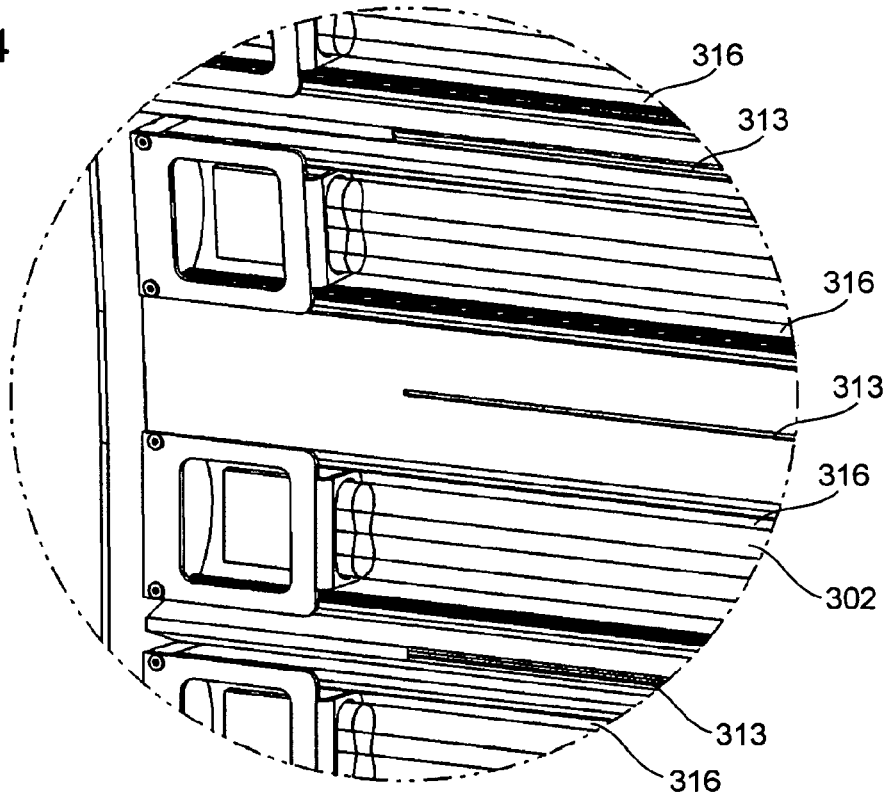
FIG. 4 an enlarged schematic illustration of a region of FIG. 3.
Figure 5:
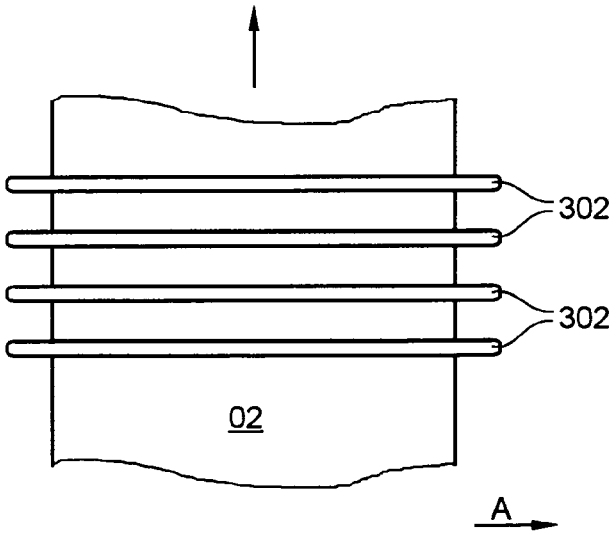
FIG. 5 a schematic illustration of a printing material web and a plurality of radiation sources of a dryer.
Figure 6:
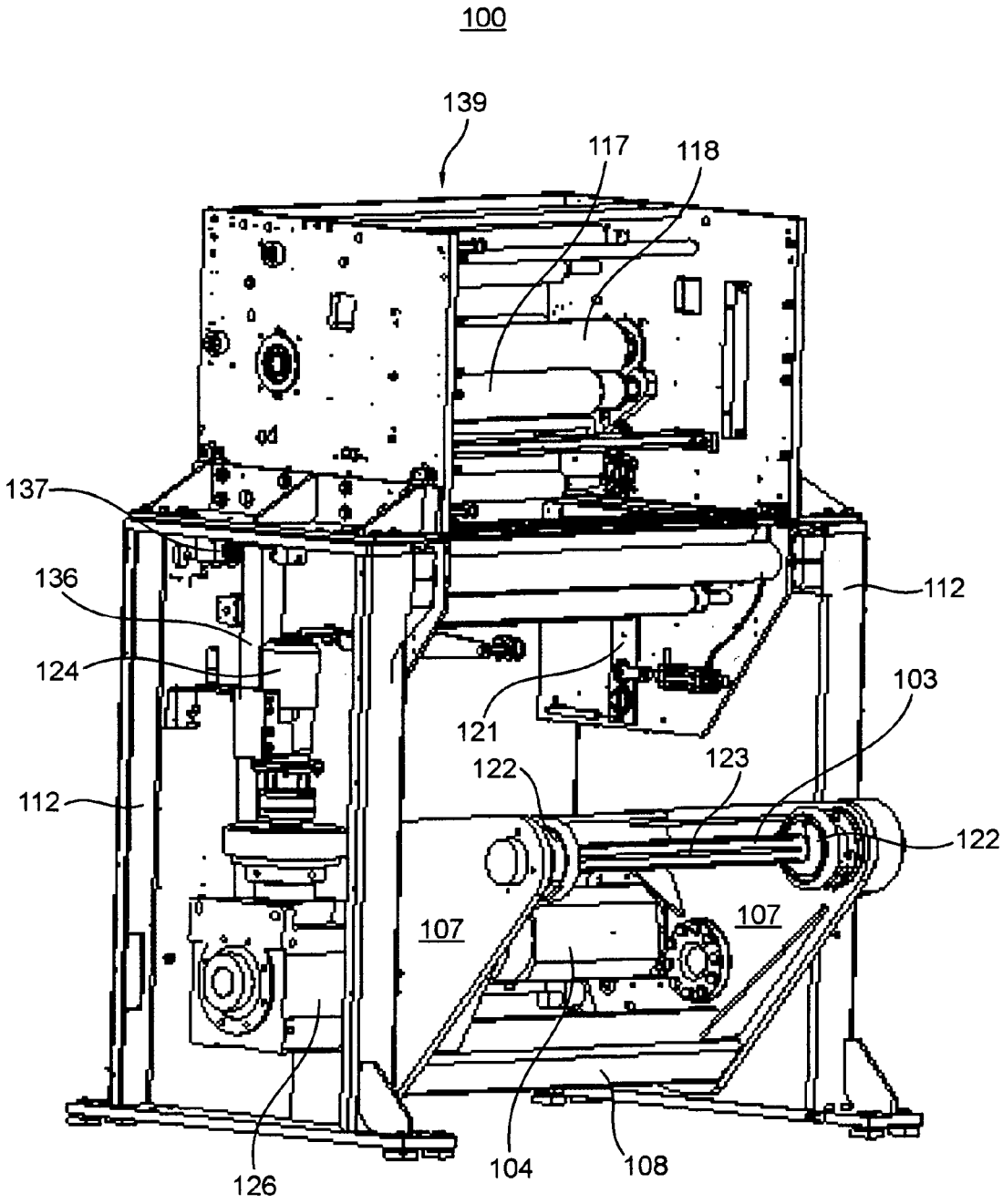
FIG. 6 a schematic illustration of a roll unwinding device.
Figure 7:
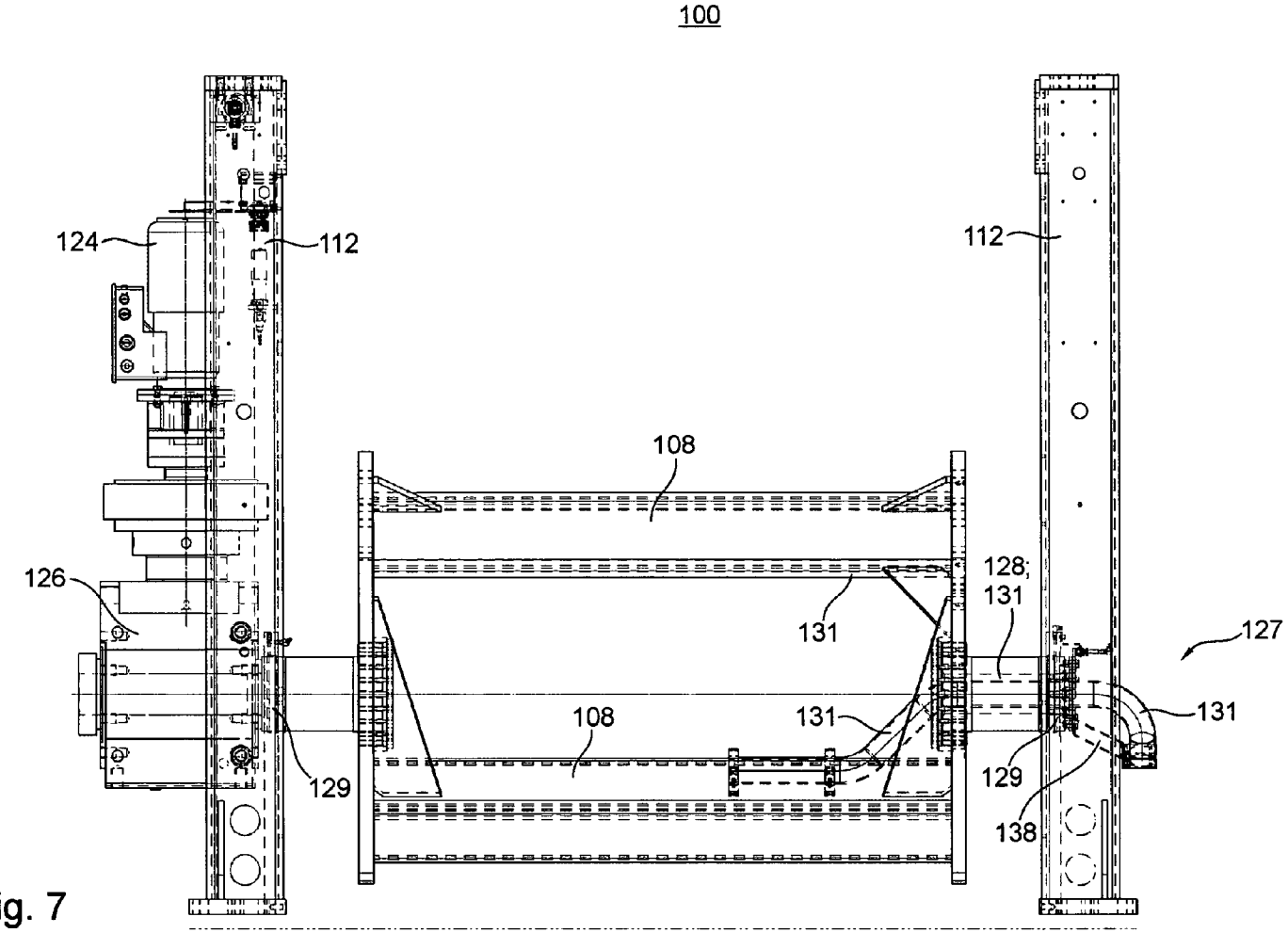
FIG. 7 a schematic illustration of part of a roll unwinding device.
Figure 8:
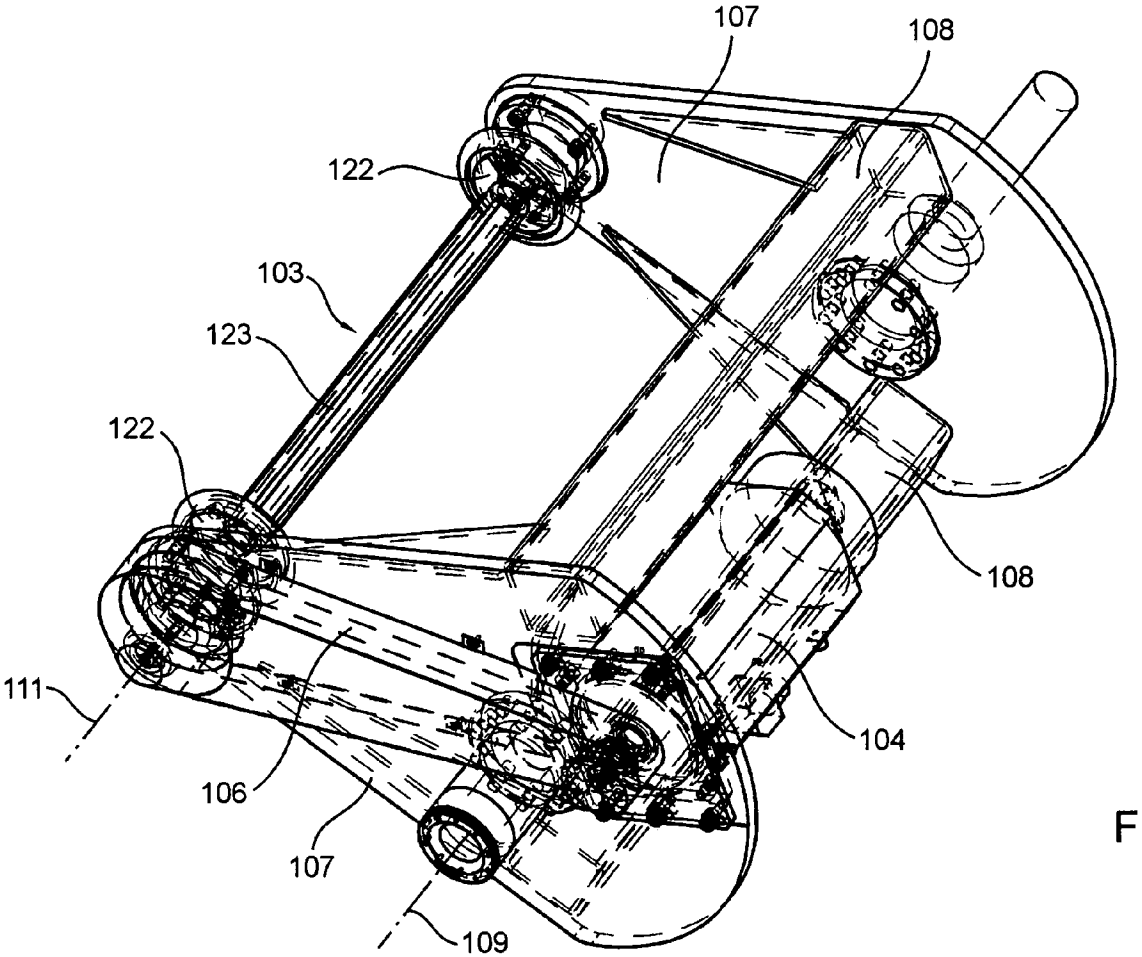
FIG. 8 a schematic illustration of a support frame of a roll unwinding device.
Figure 9:
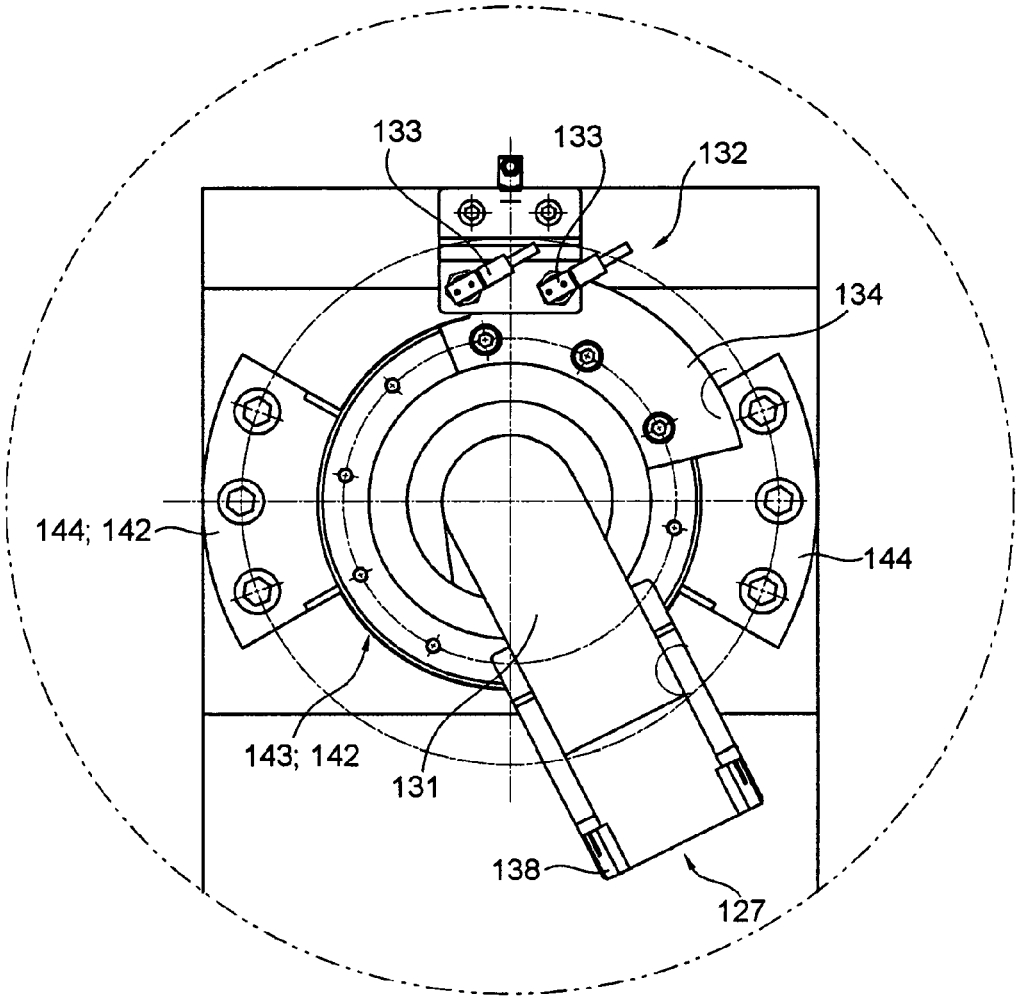
FIG. 9 a schematic illustration of an infeed device of a roll unwinding device.

A printing machine 01 has at least one printing material source 100, at least one first printing unit 200, preferably at least one first dryer 301, preferably at least one second printing unit 400 and preferably at least one second dryer 331 and at least one post-processing apparatus 500. The printing machine 01 is preferably embodied as an inkjet printing machine 01. The printing machine 01 is preferably embodied as a web-fed printing machine 01, and more preferably as a web-fed inkjet printing machine 01. The printing machine 01 is embodied, for example, as a rotary printing machine 01, for example, as a web-fed rotary printing machine 01, particularly as a web-fed rotary inkjet printing machine 01. In the case of a web-fed printing machine 01, the printing material source 100 is embodied as a roll unwinding device 100. In the case of a sheet-fed rotary printing machine, the printing material source 100 is embodied as a sheet feeder. In the printing material source 100, printing material 02 is aligned, preferably with respect to at least one edge of the printing material 02. In the roll unwinding device 100 of a web-fed printing machine 01, a web-type printing material 02, that is, a printing material web 02, for example, a paper web 02 or a textile web 02 or a film 02, for example a plastic film 02 or a metal film 02, is unwound from a printing material roll 101, and is preferably aligned with respect to the edges of said material. The printing material 02, and particularly the printing material web 02, is then guided through the at least one first printing unit 200, where the printing material 02 and particularly the printing material web 02 is provided on at least one side with a printed image using at least one printing ink.

After passing through the at least one first printing unit 200, the printing material 02 and particularly the printing material web 02 preferably passes through the at least one first dryer 301, to dry the printing ink that has been applied. Printing ink in the above and in what follows is generally understood as a coating agent, particularly a varnish. The at least one first dryer 301 is preferably a component of a dryer unit 300. After passing through the at least one first dryer 301 and preferably the at least one second printing unit 400 and/or the at least one second dryer 331, the printing material 02 and particularly the printing material web 02 is preferably fed to the at least one post-processing apparatus 500, where it is processed further. The at least one post-processing apparatus 500 is embodied, for example, as at least one folding device 500 and/or as a winding device 500. In the at least one folding device 500, the printing material 02 that has preferably been imprinted on two sides is further processed to produce individual printed products. More particularly, this means that, along a transport path of the printing material 02 and particularly of the printing material web 02 through the printing machine 01, at least the first dryer 301 is preferably arranged downstream of the at least one first printing unit 200, followed by at least the second printing unit 400, which is followed by the at least one second dryer 331. This serves to ensure a high-quality, two-sided printing of the printing material 02 and particularly of the printing material web 02.

In what follows, a web-fed printing machine 01 will be described in greater detail. However, relevant details can also be transferred to other printing machines 01, for example, sheet-fed printing machines, as long as no incompatibilities exist. Printing material rolls 101 which are preferably used in the roll unwinding device 100 preferably each have a core onto which the web-type printing material 02 is wound for use in the web-fed printing machine 01. The width of the printing material web 02 is preferably 700 mm to 900 mm, but may also be smaller or preferably larger. At least one printing material roll 101 is rotatably arranged in the roll unwinding device 100. In a preferred variant, the roll unwinding device 100 is suitably embodied for receiving one printing material roll 101, and thus has only one storage position for a printing material roll 101. In another variant, the roll unwinding device 100 is embodied as a roll changer 100 and has storage positions for at least two printing material rolls 101 and preferably enables a flying roll change, that is, a connection of a first printing material web 02 of a printing material roll 101 currently being processed to a second printing material web 02 of a printing material roll 101 that will subsequently be processed, while both the printing material roll 101 currently being processed and the printing material roll 101 that will subsequently be processed are rotating.

The roll unwinding device 100 preferably has at least one roll holding device 103, embodied, for example, as a chucking device 103 and/or as a clamping device 103, for each storage position. The at least one roll holding device 103 preferably represents at least one first motor-driven rotating body 103. The at least one roll holding device 103 is used for the rotatable mounting of at least one printing material roll 101. The at least one roll holding device 103 is preferably in contact with the core of the printing material roll 101. A clamping device 103 in this case is a roll holding device 103 in which contact that transfers and/or is capable of transferring torque is produced between the clamping device 103 and the printing material roll 101 in that moving the clamping device 103 relative to the printing material roll 101 in an axial direction A, referred to the printing material roll 101, produces contact between the printing material roll 101 and the clamping device 103 which is sufficient for transferring torque. Such contact exists, for example, when the clamping device 103 is pressed far enough in the axial direction A against the printing material roll 101 and particularly the core thereof, and/or when the clamping device 103 cuts at least partially into the core of the printing material roll 101 as a result of relative movement in the axial direction A, and/or when the clamping device 103 is connected in an interlocking fashion with the printing material roll 101 with respect to movements in the circumferential direction, solely as a result of movement in the axial direction A relative to the printing material roll 101. Such a clamping device 103 can be in the form of two clamping mandrels 103 or clamping cones 103, for example, at least one of which is arranged displaceably in the axial direction A. A chucking device 103 in this case is a roll holding device 103 in which contact that transfers and/or is capable of transferring torque is produced between the chucking device 103 and the printing material roll 101 in that, following an at least partial insertion of the chucking device 103 into an opening in the printing material roll 101, at least one component of the chucking device 103, for example, at least one carrier element embodied as a clamping jaw, is moved in a direction which has a component in a radial direction with respect to the printing material roll 101 relative to the rest of the chucking device 103 and relative to the printing material roll 101, until a force-fitted and/or interlocking connection between the chucking device 103 and the printing material roll 101 is produced. The at least one chucking device 103 is preferably embodied as two chucking mandrels 103 or chucking cones 103, or more preferably as a clamping shaft 103.

The at least one roll holding device 103 preferably has at least one drive motor 104, and preferably can be and/or is rotationally driven by this at least one drive motor 104 or by each drive motor. Thus the roll unwinding device 100 particularly has at least one drive motor 104. The at least one drive motor 104 is preferably embodied as at least one electric motor 104 and more preferably as at least one position-controlled electric motor 104. The at least one drive motor 104 is preferably the sole controllable component of the roll unwinding device 100, by means of which a specific acceleration or deceleration of a rotation of the clamping shaft 103 about the rotational axis 111 thereof can be executed. A drive controller of the at least one drive motor 104 is preferably provided. This drive controller is preferably configured for various operating modes.

A first operating mode involves accelerating the printing material roll 101 and holding it at a substantially constant rotational speed. This is the case, for example, during a printing operation of the printing machine 01. A second operating mode involves operating the drive motor 104 in generator operation. In this case, the drive motor 104 is controlled by the drive controller so as to decelerate the rotation of the printing material roll 101, producing electrical energy. Thus rotational energy is converted to electrical energy and is stored in a main power network and/or an electrical energy storage device, for example. A third operating mode involves modifying a phase position of the drive motor 104 controller, to a more or less opposite phase driving of the at least one drive motor 104. In this mode, electrical energy is expended to actively decelerate the rotation of the printing material roll 101. This is the case, for example, when, in the event of an emergency, it is necessary to stop the printing machine 01 as quickly as possible. Such an operating mode is also known as plug braking. It is also conceivable to provide multiple drive motors 104 and to operate some of the drive motors 104 in generator operation, and to use the electrical energy obtained thereby for the phase opposition driving of others of the drive motors 104. In this manner, depending on requirements, greater emphasis may be placed on a rapid or an energy-saving deceleration and/or stoppage of the printing material roll 101.

In the case of chucking mandrels 103 or clamping mandrels 103, the at least one drive motor 104 of the at least one roll holding device 103 is preferably connected via at least one torque transfer device 106, preferably a traction means 106, for example, a belt 106 and preferably a toothed belt 106, to the respective clamping mandrel(s) 103 or chucking mandrel(s) 103. The torque transfer device 106 can also be embodied, for example, as at least one gear wheel 106. However, a belt 106 or a chain 106 offers advantages in terms of weight, and usually has a lower mass, which helps to conserve energy during accelerations. In the case of a clamping shaft 103, the at least one drive motor 104 of the clamping shaft 103 is preferably connected, via the at least one torque transfer device 106, embodied, for example, as at least one gear wheel 106, and preferably as at least one traction means 106, for example, as a chain 106 or a belt 106, and more preferably as at least one toothed belt 106, to at least one clamping shaft bearing 122 so as to transfer and/or be capable of transferring torque.

The at least one roll holding device 103 and/or the drive motor 104 or drive motors 104 thereof are preferably each connected via at least one supporting arm 107 to a preferably common axle 108 or at least one common support 108 or support frame 108, around which or with which all existing storage positions are rotatably and/or pivotably arranged. This allows the at least one printing material roll 101 to be adjusted with respect to the position of its rotational axis 111 and its outer surface during a mounting of the at least one printing material roll 101 in the roll unwinding device 100 and/or during a removal of a residual core or residual roll of the printing material roll 101 from the roll unwinding device 100 and/or during a flying roll change and/or during an ongoing printing operation with a decreasing roll diameter. The drive motor 104 is preferably connected to the printing material roll 101, preferably solely via the corresponding roll holding device 103, and more particularly, is not connected via a belt to an outer cylinder surface of the printing material roll 101.

A first preferred variant of the roll unwinding device 100 will first be described, in which two clamping shaft bearings 122 and one clamping shaft 103 are provided at each storage position. However, all specifications may be transferred accordingly to a variant of the roll holding device 103 as a chucking device 103 in general or as a clamping device 103, as long as no incompatibilities exist. The at least one and preferably precisely one storage position preferably has two supporting arms 107, each of which has one clamping shaft bearing 122, preferably embodied as a bearing cap 122. The roll unwinding device 100 thus preferably has precisely two supporting arms 107. At least one clamping shaft bearing 122 is connected and/or connectable to the clamping shaft 103 so as to transfer and/or be capable of transferring torque. At least one clamping shaft bearing 122 has a closure element, which in the case of a bearing cap 122 is preferably pivotable about a closure axis. The closure axis preferably has at least one component that is aligned orthogonally to the rotational axis 111 of the clamping shaft 103. As a result of this feature, when the clamping shaft 103 arranged in the bearing caps 122 rotates, there is no danger of the bearing cap 122 opening as a result of this rotation. The respective clamping shaft bearing 122 is opened and/or closed by pivoting the closure element. To load a printing material roll 101, the clamping shaft bearings 122 of the two supporting arms 107 are opened. A clamping shaft 103 is guided through an opening in the core of the printing material roll 101 so that an axial end of the clamping shaft 103 projects out of the core of the printing material roll 101 at each axial end of the core of the printing material roll 101. The clamping shaft 103 preferably has at least two carrier elements 123, preferably embodied as clamping jaws 123. The clamping shaft 103 further forms a continuous supporting journal, to which the carrier elements 123, preferably embodied as clamping jaws 123, are preferably movably connected. The carrier elements 123, preferably embodied as clamping jaws 123, are connected to the clamping shaft 103 such that their position can be adjusted, at least in a radial direction with respect to a rotational axis 111 of the clamping shaft 103, which coincides with the rotational axis 111 of the printing material roll 101. When the carrier elements 123 preferably embodied as clamping jaws 123 are in a freely operating state, all the components of the carrier elements 123 preferably embodied as clamping jaws 123 lie within a radius that is defined by the maximum radial dimension of the supporting journal. When the carrier elements 123 preferably embodied as clamping jaws 123 are in a clamped operating state, parts of the carrier elements 123 preferably embodied as clamping jaws 123 lie outside of this radius. The carrier elements 123 preferably embodied as clamping jaws 123 are preferably movable by means of a pneumatic system. The pneumatic system preferably operates against the spring force of at least one provided spring, wherein the spring force is preferably embodied as forcing the carrier elements 123 preferably embodied as clamping jaws 123 into the freely operating state. The carrier elements 123 preferably embodied as clamping jaws 123 are then moved to the clamped operating state via at least one pneumatic device connected to a pneumatic connection. The clamped operating state is durably secured via at least one valve, which is part of the pneumatic system, or is transferred to the freely operating state by opening said valve. In the clamped operating state, the clamping shaft 103 is non-rotatably connected to the core of the printing material roll 101 so as to transfer and/or be capable of transferring torque.

The clamping shaft 103, together with the printing material roll 101, is placed with the two ends thereof in the two clamping shaft bearings 122. The two clamping shaft bearings 122 are then closed, preferably by pivoting the closure elements to a closed position. A locking device for each of the clamping shaft bearings 122 is likewise preferably closed, for example, by snap-locking a spring-mounted securing journal into a corresponding recess, or by rotating a hand wheel to a corresponding position. Once the clamping shaft bearings 122 have been closed, the clamping shaft bearings 122 are connected to the clamping shaft 103 so as to transfer and/or be capable of transferring torque. The clamping shaft 103 is preferably installed in the clamping shaft bearings 122 by inserting the clamping shaft 103 in a direction having a vertically downward directed component into the clamping shaft bearings 122, for example, lowering it by means of a crane or a lift carriage, for example, and/or by moving the clamping shaft bearings 122, preferably together with respective supporting arms 107, in a direction having a vertically upward directed component, causing the bearings to receive the clamping shaft 103 and, more preferably, to raise the clamping shaft 103 together with the printing material roll 101. For this purpose, the printing material roll 101 together with the clamping shaft 103 is first moved to a corresponding receiving position. This is accomplished, for example, by rolling the printing material roll 101 or with the help of a transport means, for example a lifting carriage or a transporting carriage of a fixedly arranged transport system, for example, partially recessed into the floor. A suitable, particularly centered positioning of the printing material roll 101 relative to the clamping shaft 103 results in a roll unwinding device 100 that is suitable for all web widths up to a maximum web width. More particularly, this allows different web widths to be processed without adjusting the roll unwinding device 100. In the opened state, the clamping shaft bearings 122 each have an opening angle of preferably between 40° and 80°. This opening angle is an angle that lies in a plane to which the rotational axis 111 of the clamping shaft 103 is orthogonally oriented. More preferably, the clamping shaft bearings 122 have a permissible angular position range for opening the clamping shaft bearings 122 of preferably between 5° and 90° and more preferably between 40° and 80°. This angular position range is an angle that lies in a plane to which the rotational axis 111 of the clamping shaft 103 is orthogonally oriented. Only when a respective clamping shaft bearing 122 is located in a rotational angle position that lies within this permissible angular position range can the respective clamping shaft bearing 122 be opened. If the respective clamping shaft bearing 122 is in a rotational angle position that lies outside of this permissible angular position range, it will close automatically and/or cannot be opened.

Each of the two clamping shaft bearings 122 is preferably connected via a supporting arm 107 to the at least one common support 108 or support frame 108. The two supporting arms 107 and the at least one common support 108 or support frame 108 are preferably embodied as a single component. The two supporting arms 107 and the at least one common support 108 or support frame 108, and therefore preferably also the at least two clamping shaft bearings 122, are arranged so as to pivot around a pivot axis 109, particularly relative to a preferably stationary frame 112 of the roll unwinding device 100. The pivot axis 109 is different from the rotational axis 111 of the clamping shaft 103, but is preferably arranged parallel thereto. To this end, the at least one common support 108 or support frame 108 is mounted at two ends referred to the axial direction A, each in at least one bearing 129. The at least one bearing 129 is preferably embodied as a roller bearing 129 and/or as a plain bearing 129. As a result of pivoting movements of the supporting arms 107 and of the at least one common support 108 or support frame 108, a printing material roll 101 is loaded and/or the position thereof is adjusted and/or released, or the supporting arms 107 and the at least one common support 108 or support frame 108 is aligned in its position, for example, in preparation for loading a printing material roll 101. More particularly, the at least one common support 108 or support frame 108 and the clamping shaft bearings 122 and the roll holding device 103 are preferably pivotable about the same pivot axis 109.

At least one pivot drive 124 is preferably positioned so as to effect and/or be capable of effecting a pivoting movement of the at least one common support 108 or support frame 108 relative to the frame 112 of the roll unwinding device 100. To receive and/or to release a printing material roll 101 by means of the roll unwinding device 100, the two supporting arms 107 and the at least one common support 108 or support frame 108 are preferably manually or automatically moved to least one suitable pivoted position, preferably on the basis of a diameter of the printing material roll 101. In the case of manual operation, this is preferably accomplished gradually and under visual monitoring by an operator. In the case of automated operation, at least one sensor, for example, an optical and/or acoustic and/or inductive sensor, for example, a laser sensor and/or an ultrasound sensor, is preferably provided, which determines the diameter of the printing material roll 101 and passes this on to a machine controller, which then moves the two supporting arms 107 and the at least one common support 108 or support frame 108 to a suitable pivoted position. During printing operation, the diameter of the printing material roll 101 is determined, at least as needed, from the angular velocity of the printing material roll 101 and the transport speed of the printing material web 02.

The roll unwinding device 100 preferably has precisely one storage position for precisely one printing material roll 101. Therefore, it is not necessary for the at least one common support 108 or support frame 108 to be capable of executing multiple revolutions, as would be necessary, for example, in the case of multiple successive flying roll changes. The at least one common support 108 or support frame 108 is pivotable about the pivot axis 109 by an angle of preferably less than 360°, and more preferably less than 180°, and more preferably still less than 80°. The angle preferably measures at least 20° and more preferably at least 45°. This allows printing material rolls 101 of different diameters to be processed. This angle is determined by the ends of a pivoting range, the dimensions of which are preferably such that the at least one common support 108 or support frame 108 can receive or discharge an empty core on the floor, and such that a printing material roll 101 up to a maximum diameter can always be held in an unwinding position that corresponds to a current diameter. To limit the pivoting range, a pivoting range limiter 132 is preferably provided. In a preferred variant of the pivoting range limiter 132, the pivoting range limiter 132 has at least one position sensor 133, for example, at least one optical and/or acoustic and/or inductive position sensor 133. The pivoting range limiter 132 preferably has at least one reference component 134, which more preferably is detected and/or detectable by the at least one position sensor 133.

In one preferred variant, the pivoting range limiter 132 has two position sensors 133, preferably embodied as inductive position sensors 133, and the pivoting range limiter 132 has a reference component 134, preferably embodied as segment-shaped. The reference component 134 is preferably arranged rigidly in relation to the at least one common support 108 or support frame 108, whereas the at least one position sensor 133 is preferably arranged rigidly in relation to the frame 112 of the roll unwinding device 100. This serves to facilitate the supply of electric power to the at least one position sensor 133, for example. The corresponding dimensioning of the reference component 134 and the corresponding arrangement of the reference component 134 and the position sensors 133 relative to one another ensure that the two end positions of the pivoting range can be detected. In another variant, a rotational angle sensor is provided, the signals of which are transmitted to a machine controller. The machine controller then decides on the basis of stored data whether an end of a permissible pivoting range has been reached.

In a first, preferred variant of the pivot drive 124, the pivot drive 124 is embodied as at least one electric motor 124, the rotor of which is connected, directly or with the interconnection of torque transfer elements, to the at least one common support 108 or support frame 108 so as to transfer and/or be capable of transferring torque. The rotor of the at least one electric motor 124 is preferably connected via at least one bevel gear system 126 to the at least one common support 108 or support frame 108 so as to transfer and/or be capable of transferring torque. This results in a space-saving configuration. A corresponding transmission is preferably provided in order to make the demands of the electric motor 124 consistent with those of the at least one common support 108 or support frame 108. A stator and/or a housing of the pivot drive 124 is preferably arranged non-rotatably, or more preferably supported via a torque support 136, on the frame 112 of the roll unwinding device 100. The torque support 136 is in contact with the frame 112 of the roll unwinding device 100, in at least one contact point, directly or preferably via at least one torque limiter 137. Providing the torque support 136 and dispensing with a rigid arrangement of the stator of the electric motor 124 on the frame 112 of the roll unwinding device 100 allows strains within the bevel gear system 126 and/or the electric motor 124 to be avoided, which otherwise might be caused, for example, by a deflection of the at least one common support 108 or support frame 108.

The torque limiter 137 preferably has at least one torque sensor, which consists of a spring package and an initiator, for example. When a maximum permissible torque is exceeded, the spring package is compressed via a corresponding deflection of the torque support 136 until the initiator registers that a maximum permissible deflection of the torque support 136 has been reached. In response to a corresponding signal from this torque sensor, the pivot drive 124 is then switched off. This serves to ensure that the preferably manually controlled pivot drive 124 will not become damaged and/or cause damage as a result of improper operation. With a corresponding configuration of a torque limiter 137 or arrangement of two torque limiters 137, both possible pivot directions are protected. For emergencies, the electric motor 124 preferably has a connection for a crank handle, which is covered by a sensor-monitored cover. When the sensor-monitored cover is open, the electric motor 124 can be operated only manually.

At least one position limiter 142 is preferably provided, which holds the axial movement of the at least one common support 108 or support frame 108 within limits, or preferably prevents such movement substantially, and more preferably prevents such movement entirely. The position limiter 142 preferably has at least one annular groove 143 and at least one stop 144 arranged at least partially in the annular groove 143. The at least one annular groove 143 is preferably arranged rigidly in relation to the at least one common support 108 or support frame 108, and the at least one stop 144 is preferably arranged rigidly in relation to the frame 112 of the roll unwinding device 100. The at least one reference component 134 of the pivoting range limiter 132 is preferably rigidly connected to a component of the position limiter 142, or is part of said position limiter 142. This allows multiple components, all of which serve to align the at least one common support 108 or support frame 108 and/or to adjust a permissible range of motion of the at least one common support 108 or support frame 108, to be readily accessed simultaneously. In a second variant of the pivot drive 124, the pivot drive 124 is embodied as at least one hydraulic cylinder 124, which is supported against the frame 112 of the roll unwinding device 100 at one end and against the at least one common support 108 or support frame 108 at the other end. In a third variant of the pivot drive 124, the pivot drive 124 is embodied as at least one electric lifting cylinder drive 124, which is supported against the frame 112 of the roll unwinding device 100 at one end and against the at least one common support 108 or support frame 108 at the other end. Such an electric lifting cylinder drive 124 has at least one electric motor and at least one threaded spindle, preferably embodied as a trapezoidal threaded spindle, connected to the electric motor so as to transfer and/or be capable of transferring torque. The threaded spindle is further engaged with a threaded nut, which is connected via a corresponding bearing to the at least one common support 108 or support frame 108. The connection of threaded spindle and threaded nut is preferably self-locking and is therefore particularly well suited to this application. The second and third variants of the pivot drive 124 also preferably have at least one torque limiter, which can be embodied as a slip clutch and/or as at least one end position sensor, for example, in the case of the electric lifting cylinder drive 124.

Regardless of the variant of the pivot drive 124, the drive motor 104 of the at least one roll holding device 103, which effects and/or accelerates and/or decelerates and/or maintains a rotation of the printing material roll 101 about the rotational axis 111 thereof, preferably via the at least one torque transfer element 106, is rigidly positioned on the at least one common support 108 or support frame 108. At least one stator of this drive motor 104 is preferably arranged rigidly on the at least one common support 108 or support frame 108. Therefore, the drive motor 104 is arranged so as to pivot together with the at least one common support 108 or support frame 108 about the pivot axis 109. This means that when the at least one common support 108 or support frame 108 executes a pivoting movement, induced, for example, by the pivot drive 124, the drive motor 104 is pivoted along with it. A constant position of the drive motor 104 relative to the printing material roll 101 and relative to the storage position thereof is thereby ensured. This results in constant operating conditions for the drive motor 104 and for the torque transfer element 106, particularly a belt 106, preferably connected thereto. A plane that contains the entire pivot axis 109 and extends in a vertical direction preferably separates the rotational axis 111 of the clamping shaft 103 from the rotational axis of the drive motor 104 at all times and in every operationally permissible angular position of the at least one common support 108 or support frame 108. This results in an advantageous distribution of weight, since the weights of drive motor 104 and printing material roll 101 are aligned so as to produce opposing torques.

At least one infeed device 127 is preferably arranged on at least one side of the frame 112 of the roll unwinding device 100, referred to the axial direction A. This at least one infeed device 127 serves to supply the drive motor 104 and/or other components rigidly disposed on the at least one common support 108 or support frame 108 with power and/or with cooling fluid and/or with compressed air and/or with hydraulic fluid. This infeed device 127 is preferably dedicated to a bearing 129 of the at least one common support 108 or support frame 108. The infeed device 127 preferably has at least one feed-through 128, more preferably embodied as an opening 128. The pivot axis 109 of the at least one common support 108 or common support frame 108 of the roll unwinding device 100 extends through this opening 128. This means, specifically, that a straight line extending along the pivot axis 109 of the at least one common support 108 or common support frame 108 through the bearing 129 to which the infeed device 127 is assigned, is free of components of this bearing 129 to which the infeed device 127 is assigned. The opening 128 preferably has a circular cross-section and/or extends, at least in sections, coaxially to the pivot axis 109 of the at least one common support 108 or support frame 108. The bearing 129 to which the infeed device 127 is assigned preferably has an outer ring, non-rotatably connected to the frame 112 of the roll unwinding device 100, and preferably has an inner ring, non-rotatably connected to the at least one common support 108 or support frame 108. The outer ring preferably has an inner diameter that is at least equal to and preferably greater than the outer diameter of the inner ring. The opening 128 preferably extends through the inner ring and through the outer ring. The infeed device 127 preferably has a tubular component 131, which lines the opening 128. This tubular component 131 is preferably made of a plastic material. The tubular component 131 is embodied either as a single component or as a group of components.

At least one line, for example, at least one power supply line and/or at least one fluid supply line, is arranged extending through the opening 128. A first end of the at least one line is rigidly connected to a component which is arranged fixedly in relation to the frame 112 of the roll unwinding device 100, and a second end of the at least one line is rigidly connected to a component which is arranged fixedly in relation to the at least one common support 108 or support frame 108. The at least one line in this case has at least one irreversibly separable component, which extends from the first end of the at least one line up to the second end of the at least one line, and/or has a plurality of irreversibly separable components, which together extend from the first end of the at least one line up to the second end of the at least one line, and are connected to one another in an interlocking and/or force-fitted connection. This means that the at least one line can be severed between its first end and its second end only by separating at least one interlocking and/or force-fitted connection and/or by irreversibly destroying components of the at least one line.

An interlocking and/or force-fitted connection is produced, for example, by a combination of plug connectors and/or by a threaded connection.

Because the pivoting range of the at least one common support 108 or support frame 108 is limited to an angle of preferably less than 360°, more preferably less than 180° and more preferably still less than 80°, a rotating union is not necessary, and more particularly, no such union that would permit full revolutions or more. This reduces structural expense and is associated with decreased costs, in terms of both purchasing and operation, over a rotary connection. More particularly, the difficulties that arise in connection with the wear and tear of sliding contacts or losses from inductive transmissions in the case of power supply lines, or that arise in connection with leaks and/or wear and tear on rotating unions in the case of fluid lines, are eliminated. In the simplest case, the at least one line is at least one cable and/or at least one hose, which is rigidly connected at its first end to a component that is arranged fixedly in relation to the frame 112 of the roll unwinding device 100, and which is rigidly connected at its second end to a component that is arranged fixedly in relation to the at least one common support 108 or support frame 108. A cable can comprise a plurality of cable sections that are connected by plug-type connections and/or threaded connections, for example. A hose can comprise a plurality of hose sections that are connected by threaded connections and/or plug-type connections, for example.

The tubular component 131 preferably has a plurality of sections. A preferred first section is bent by an angle of at least 30° and at most 150°, more preferably at least 70° and at most 110°. The at least one line is conducted through the first section around a curve in a defined manner, before said line passes through the bearing 129. Mechanical wear and tear on the at least one line is thereby reduced. The first section preferably has an inlet opening, through which the at least one line is fed to the tubular component 131. The first section is located on a side of the frame 112 that faces away from the common support 108 or support frame 108. Further preferably, a second section is attached to the first section. The second section preferably extends parallel and more preferably coaxially to the pivot axis 109 of the at least one common support 108 or support frame 108. The second section preferably extends through the bearing 129. The second section preferably extends through the bearing 129. The second section preferably extends from a side of the frame 112 that faces away from the common support 108 or support frame 108, up to a region inside the frame 112 of the roll unwinding device 100. A third section is preferably attached to the second section.

The third section has at least one curve and preferably two curves, each having an angle of preferably at least 10° and at most 100°, and more preferably at least 20° and at most 60°. The at least one line is conducted through the third section away from the pivot axis 109 and up to the drive motor 104 of the at least one roll holding device 103 or to another component arranged rigidly in relation to the at least one common support 108 and/or support frame 108. A defined position of the at least one line relative to the drive motor 104 and/or relative to the other component which is arranged rigidly in relation to the at least one common support 108 or support frame 108 is thereby established, permanently and independently of the pivot position of the at least one common support 108 or support frame 108. The first section and/or the third section preferably have a mounting 138, which can be embodied, for example, as a support 138, and which forms a rigid position of the first and/or third sections of the tubular component 131 relative to the at least one common support 108 or support frame 108. The third section, and therefore the entire tubular component 131, preferably ends at a maximum distance of 50 cm from the drive motor 104.

A second variant of the roll unwinding device 100, in which two chucking mandrels 103 or clamping mandrels 103 are provided for each storage position, will be described in the following. However, all specifications may also be transferred generally to the at least one roll holding device 103, as long as no incompatibilities exist. To allow a printing material roll 101 to be loaded onto the at least one roll holding device 103, in the case of chucking mandrels 103 or clamping mandrels 103, at least one of the chucking mandrels 103 or clamping mandrels 103, and preferably both chucking mandrels 103 or clamping mandrels 103, are displaceable in and/or counter to the axial direction A. This axial direction A is aligned parallel to the rotational axis 111 of the printing material roll 101 and optionally parallel to the pivot axis 109 of the at least one common support 108 or support frame 108 of the roll unwinding device 100. This means that the axial direction A is likewise a direction A along the width of the printing material web 02. When the printing material roll 101 is in a loaded state, the rotational axis 111 of the printing material roll 101 is also the rotational axis 111 of the chucking mandrels 103 or clamping mandrels 103 that are in contact with said printing material roll 101. In the case of chucking mandrels 103, the chucking mandrels 103 preferably each have at least two carrier elements, preferably embodied as clamping jaws. The chucking mandrels 103 further each have a supporting journal, to which the carrier elements preferably embodied as clamping jaws are preferably movably connected. The positions of the carrier elements preferably embodied as clamping jaws are adjustable, at least in a radial direction with respect to a rotational axis 111 of the chucking mandrels 103, which axis coincides with the rotational axis 111 of the printing material roll 101. When the carrier elements preferably embodied as clamping jaws are in a freely operating state, all the components of the carrier elements preferably embodied as clamping jaws lie within a radius defined by a maximum radial dimension of the supporting journal. When the carrier elements preferably embodied as clamping jaws are in a clamped operating state, parts of the carrier elements preferably embodied as clamping jaws lie outside of this radius defined by the maximum radial dimension of the supporting journal.

Regardless of whether the roll unwinding device 100 is in the first or the second variant, the roll unwinding device 100 preferably further comprises the frame 112 that supports the at least one common support 108 or support frame 108 via bearings 129. Along a transport path of a printing material web 02 downstream of the roll holding device 103, the roll unwinding device 100 preferably comprises a dancer roller 113 arranged on a dancer lever 121 and/or a web edge aligner 114 and/or an infeed unit 139 having an infeed nip 119 formed by a traction roller 118 and a traction impression roller 117, and a first measuring device 141 embodied as a first measuring roller 141, particularly an infeed measuring roller 141. This traction roller 118 preferably has an integral drive motor 146, embodied as a traction drive motor 146, which is preferably connected to a machine controller. The traction roller 118 preferably represents at least one second motor-driven rotating body 118. A web tension can be adjusted and can be held within limits and/or the web tension is preferably held within limits by means of the dancer roller 113, which is preferably displaceably disposed on a dancer lever 121. The dancer roller 113 is preferably used to adjust for inconsistencies in web tension, for example, in the case of printing material rolls 101 running out of round. The roll unwinding device 100 optionally has a splicing and cutting unit, which can be used to implement a flying roll change, i.e., without stopping movement of the printing material web 02.

The roll unwinding device 100 preferably has the web edge aligner 114, which is also called a web aligner 114. This web edge aligner 114 is preferably a first web edge aligner 114. This web edge aligner 114 is preferably arranged upstream of the at least one first printing unit 200 with respect to the transport path of the printing material web 02. This web edge aligner 114 has at least two alignment rollers 116, aligned at least substantially and preferably precisely parallel to one another, around which the printing material web 02 wraps during printing operation, and the rotational axes of which can be adjusted individually and/or together in terms of their respective angular position in space and/or in relation to a direction of transport of the printing material web 02. The two alignment rollers 116 are preferably arranged on a frame and can pivot together about a pivot axis, which is oriented perpendicular to a plane that contains the rotational axes of the alignment rollers 116. The web edge aligner 114 is used to align the printing material web 02 in terms of its lateral position, that is, the position of the edges of said web is aligned with respect to the direction A along the width of the printing material web 02, which lies orthogonally to the direction of transport of the printing material web 02. In this process, the at least two alignment rollers 116 are aligned on the basis of measurement signals from at least one sensor such that the position of the printing material web 02 wrapping around the alignment rollers 116 can be adjusted very rapidly with respect to the direction extending orthogonally to the direction of transport of the printing material web 02. For longer-term, tendential alignments of the printing material web 02, the entire printing material roll 101 is preferably moved in the direction A of its rotational axis 111. For a better utilization of space, for example, the web edge aligner 114 is preferably arranged above the supporting arms 107 of the roll unwinding device 100.

An infeed unit 139 is preferably arranged downstream of the web edge aligner 114. At least the traction roller 118 is preferably provided as a component of the infeed unit 139, with the traction impression roller 117 preferably being arranged so as to interact with said traction roller. The traction roller 118 and the traction impression roller 117 preferably form the infeed nip 119, into which the printing material web 02 is clamped or can be clamped, and through which the printing material web 02 is preferably conveyed. However, the traction roller 118 can also be embodied as a suction roller, for example. The infeed nip 119 serves to adjust a web tension and/or to transport the printing material 02. The traction impression roller 117 preferably has an outer surface made of an elastic material, for example, an elastomer. Preferably, the at least one first measuring device 141, embodied as a first measuring roller 141, particularly as an infeed measuring roller 141, is provided, by means of which a web tension can be measured. The results of these measurements are preferably used as a basis for adjusting web tension. The at least one first measuring device 141, embodied as a first measuring roller 141, particularly an infeed measuring roller 141, is preferably situated upstream of the infeed nip 119 in the direction of transport of the printing material web 02. In one variant, the traction impression roller 117 has at least one carrier, which in the case of a printing material 02 embodied as a textile web 02, improves the transport of the printing material 02. To improve the utilization of space, for example, the infeed unit 139 is preferably situated above the supporting arms 107 of the roll unwinding device 100, and more preferably at the same height as the web edge aligner 114.

A first printing unit 200 is situated downstream of the roll unwinding device 100 with respect to the transport path of the printing material web 02. The first printing unit 200 has at least one first central printing cylinder 201, or central cylinder 201. In the following, when a central cylinder 201 is mentioned, this always refers to a central printing cylinder 201. The at least one first central cylinder 201 preferably represents at least one third motor-driven rotating body 201. During printing operation, the printing material web 02 wraps at least partially around the first central cylinder 201. In this case, the wrap angle preferably measures at least 180° and more preferably at least 270°. The wrap angle in this case is the angle, measured in the circumferential direction, of an outer cylinder surface of the first central cylinder 201 along which the printing material 02 and particularly the printing material web 02 is in contact with the first central cylinder 201. Accordingly, during printing operation, preferably at least 50% and more preferably at least 75% of the outer cylinder surface of the first central cylinder 201, viewed in the circumferential direction, is in contact with the printing material web 02. This means that part of the surface of an outer cylinder surface of the at least one first central cylinder 201, provided as the contact surface between the at least one first central cylinder 201 and the printing material 02 preferably embodied as a printing material web 02, has a wrap angle around the at least one first central cylinder 201 of preferably at least 180° and more preferably at least 270°.

At least one second measuring device 216, preferably embodied as a second measuring roller 216, is preferably arranged upstream of the first central cylinder 201 of the first printing unit 200 along the transport path of the printing material web 02. This second measuring device 216, preferably embodied as a second measuring roller 216, is preferably provided for measuring web tension. At least one first printing material cleaning device 202 or web cleaning device 202 is preferably arranged upstream of the first central cylinder 201 of the first printing unit 200 along the transport path of the printing material web 02, so as to act on the printing material web 02 and/or aligned toward the transport path of the printing material web 02. The first web cleaning device 202 is preferably embodied as a first dust removal device 202. The first web cleaning device 202 preferably has at least one brush and/or at least one vacuum device and/or a device for electrostatically charging particles that adhere to the printing material web 02. The first web cleaning device 202 is assigned to at least one first side and preferably to both sides of the printing material web 02, and is particularly aligned so as to act and/or be capable of acting at least on this first side of the printing material web 02, and preferably on both sides of the printing material web 02. The infeed nip 119 formed by the traction roller 118 and the traction impression roller 117 is preferably located between the web edge aligner 114 having at least two alignment rollers 116 and the at least one first central cylinder 201, along the transport path of the printing material web 02. In a preferred variant, the at least one first web cleaning device 202 is located downstream of the infeed nip 119 and upstream of the first central cylinder 201 along the transport path of the printing material web 02, acting on the printing material web 02 and/or aligned toward the transport path of the printing material web 02.

A roller 203 of the first printing unit 200, embodied as a first deflecting roller 203, is arranged with the rotational axis thereof parallel to the first central cylinder 201. This first deflecting roller 203 is preferably arranged spaced from the first central cylinder 201. More particularly, a first gap 204 exists between the first deflecting roller 203 and the first central cylinder 201, which gap is larger than the thickness of the printing material web 02. The thickness of the printing material web 02 in this context is understood as the smallest dimension of the printing material web 02. The printing material web 02 preferably wraps around a part of the first deflecting roller 203 and is deflected by said roller such that the transport path of the printing material web 02 extends within the first gap 204 both tangentially to the first deflecting roller 203 and tangentially to the first central cylinder 201. The outer surface of the deflecting roller 203 in this case is preferably made of a relatively inflexible material, more preferably a metal, and more preferably still, steel or aluminum.

At least one first cylinder 206, embodied as a first impression roller 206, is preferably arranged in the first printing unit 200. The outer surface of the first impression roller 206 is preferably made of a flexible material, for example, an elastomer. The first impression roller 206 is preferably arranged so as to be engaged against the first central cylinder 201 and/or disengaged therefrom, more preferably in a linear direction of motion, and more preferably still, radially relative to a rotational axis 207 of the first central cylinder 201, by means of an adjustment drive. In the state in which the first impression roller 206 is engaged against the first central cylinder 201, said impression roller, together with the first central cylinder 201, forms a first impression roller nip 209. During printing operation, the printing material web 02 passes through the first impression roller nip 209. The printing material web 02 is placed flat and preferably in a clear and known position against the first central cylinder 201 by means of the first deflecting roller 203 and/or preferably by the first impression roller 206. Apart from at most the first impression roller 206 and/or optionally additional impression rollers and/or optionally at least one adhesive application device 218, preferably no additional rotational elements, particularly no additional roller and no additional cylinder, are in contact with the at least one first central cylinder 201. A plane that contains both the rotational axis 207 of the first central cylinder 201 and a rotational axis of the first impression roller 206 preferably has a surface normal that deviates from a horizontal direction by at most 20° and more preferably by at most 10°. More preferably, the rotational axis of the first impression roller 206 is situated below the rotational axis of the first central cylinder 201.

The first central cylinder 201 has an integral first drive motor 208, assigned to the first central cylinder 201, which motor is preferably embodied as an electric motor 208 and is more preferably embodied as a direct drive 208 of the first central cylinder 201. The first drive motor 208 of the first central cylinder 201 is preferably embodied as a synchronous motor 208. However, an asynchronous motor may also be used. The first drive motor 208 of the first central cylinder 201 preferably has at least one permanent magnet, which more preferably is part of a rotor of the first drive motor 208 of the first central cylinder 201.

On the first drive motor 208 of the first central cylinder 201 and/or on the first central cylinder 201 itself, a first rotational angle sensor is preferably arranged, which is embodied as measuring and/or capable of measuring a rotational angle position of the first drive motor 208 and/or of the first central cylinder 201 itself, and as transmitting and/or capable of transmitting said position to a higher-level machine controller, generally at 220, as seen in FIG. 1. The first rotational angle sensor is embodied, for example, as a rotary encoder or absolute value encoder. With a rotational angle sensor of this type, a rotational position of the first drive motor 208 and/or preferably a rotational position of the first central cylinder 201 can preferably be determined in absolute terms by means of the higher-level machine controller. The first drive motor 208 of the first central cylinder 201 is preferably located at a first axial end of the first central cylinder 201, referred to the rotational axis 207 of the first central cylinder 201, whereas the rotational angle sensor is preferably located at a second axial end of the first central cylinder 201, referred to the rotational axis 207 of the first central cylinder 201. The rotational angle sensor preferably has a particularly high resolution, for example, a resolution of at least 3,000 (three thousand) and preferably at least 10,000 (ten thousand), and more preferably at least 100,000 (one hundred thousand) increments per round angle (360°). The rotational angle sensor preferably has a high temporal sampling frequency.

Additionally or alternatively, the first drive motor 208 of the first central cylinder 201 is connected to the machine controller in terms of circuitry such that the machine controller is informed at all times as to the rotational position of the first drive motor 208, and therefore likewise as to the rotational position of the first central cylinder 201, on the basis of target data about the rotational position of the first drive motor 208, provided by the machine controller to the first drive motor 208 of the first central cylinder 201. More particularly, a region of the machine controller that defines the rotational angle position or rotational position of the first central cylinder 201 and/or of the first drive motor 201 is connected directly, particularly without an interconnected sensor, to a region of the machine controller that controls the at least one print head 212 of the first printing unit 200.

At least one first printing element 211 is arranged in the first printing unit 200. The at least one first printing element 211 is preferably arranged downstream of the first impression roller 206, aligned toward the at least one first central cylinder 201, in the direction of rotation of the first central cylinder 201 and therefore along the transport path of the printing material web 02. The at least one first printing element 211 is embodied as a first inkjet printing element 211, and is also called the first inkjet printing element 211 The first printing element 211 has at least one nozzle bar 213 and preferably a plurality of nozzle bars 213. The at least one first printing element 211 and therefore the at least one first printing unit 200 has at least one first print head 212, embodied as an inkjet print head 212. The at least one nozzle bar 213 preferably has at least one print head 212 and preferably a plurality of print heads 212. Each print head 212 preferably has a plurality of nozzles, from which droplets of printing ink are ejected and/or can be ejected. A nozzle bar 213 in this context is a component which preferably extends across at least 80% and more preferably at least 100% of the width of the printing material web 02 and/or the axial length of the body of the at least one first central cylinder 201, and serves as a support for the at least one print head 212. In this case, a single nozzle bar 213 or a plurality of nozzle bars is provided per printing element 211. A clearly defined target region, referred to the direction A along the width of the printing material web 02 and therefore to the direction A of the rotational axis 207 of the at least one first central cylinder 201, is dedicated to each nozzle. Each target region of a nozzle, particularly referred to the circumferential direction of the at least one first central cylinder 201, is clearly defined.

The at least one first nozzle bar 213 preferably extends in the axial direction A, that is, in the direction A along the width of the printing material web 02, across the entire width of the printing material web 02. The at least one nozzle bar 213 has at least one row of nozzles. The at least one row of nozzles, viewed in the axial direction A, preferably has nozzle openings at regular distances over the entire width of the printing material web 02 and/or of a body of the at least one first central cylinder 201. In one variant, a single, continuous print head 212 is provided, which extends in the axial direction A over the entire width of the printing material web 02 and/or the entire width of the body of the at least one first central cylinder 201. In this case, the at least one row of nozzles is preferably embodied as at least one linear row of individual nozzles, extending across the entire width of the printing material web 02 in axial direction A. In another preferred variant, multiple print heads 212 are arranged on the at least one nozzle bar 213, side by side, in the axial direction A. Since such individual print heads 212 usually are not equipped with nozzles up to the edges of their housing, at least two and preferably precisely two rows of print heads 212 extending in the axial direction A are preferably arranged offset from one another in the circumferential direction of the first central cylinder 201, preferably such that successive print heads 212 are always alternatingly assigned to one of the at least two rows of print heads 212 in the axial direction A, preferably always alternatingly to a first and a second of two rows of print heads 212. Two such rows of print heads 212 form a double row of print heads 212. Each double row of print heads 212 preferably has between five and fifteen print heads 212, and more preferably seven print heads 212. The at least one row of nozzles then is not embodied as a single linear row of nozzles, and is instead produced from the total of individual, particularly two, rows of nozzles arranged offset from one another in the circumferential direction.

If a print head 212 has multiple nozzles, then all the target regions of the nozzles of this print head 212 together form an operating range of said print head 212. Operating ranges of print heads 212 of a nozzle bar 213, and particularly of a double row of print heads 212, adjoin one another in the axial direction A and/or overlap one another in the axial direction A. This serves to ensure that, even if the print head 212 is not continuous in the axial direction A, target regions of nozzles of the at least one nozzle bar 213 and/or particularly of each double row of print heads 212 lie at regular and preferably periodic distances from one another, viewed in the axial direction A. In any case, an entire operating range of the at least one nozzle bar 213 preferably extends across at least 90% and more preferably across 100% of the total width of the printing material web 02 and/or the total width of the body of the at least one first central cylinder 201 in the axial direction A. A narrow region of the printing material web 02 and/or of the body of the first central cylinder 201 which is not part of the operating range of the nozzle bar 213 can be present on one or both sides with respect to the axial direction A. A total operating range of a double row of print heads 212 corresponds to the operating range of the at least one nozzle bar 213, viewed in the direction A along the width of the printing material web 02.

The at least one nozzle bar 213 preferably has multiple rows of nozzles in the circumferential direction with respect to the at least one first central cylinder 201. Each print head 212 preferably has a plurality of nozzles, which are arranged in a matrix of multiple lines in the axial direction A and/or multiple columns in the circumferential direction of the at least one first central cylinder 201. A plurality of rows of print heads 212, more preferably four double rows and more preferably still eight double rows of print heads 212, are preferably arranged one after another on the at least one first central cylinder 201, in the circumferential direction with respect to the at least one first central cylinder 201. In this case, the print heads 212 are preferably aligned such that the nozzles of each print head 212 point substantially in a radial direction toward the outer cylinder surface of the at least one first central cylinder 201. Each double row of print heads 212 is preferably assigned a printing ink of a specific color, for example one of the colors black, cyan, yellow and magenta, or a varnish, for example, a clear varnish. The corresponding inkjet printing element 211 is preferably embodied as a four-color printing element 211 and enables one-sided, four-color printing of the printing material web 02. It is also possible to print using fewer or more different colors, for example, additional special inks, using one printing element 211. More or fewer print heads 212 and/or double rows of print heads 212 are then preferably arranged accordingly within this corresponding printing element 211.

The at least one print head 212 operates by generating droplets of printing ink, preferably according to the drop-on-demand method. In principle, it is also conceivable to use print heads 212 which operate according to another method for generating droplets of printing ink, for example, the continuous inkjet method. In the drop-on-demand method, droplets of printing ink are produced in a targeted manner as needed. At least one piezoelectric element is preferably used per nozzle, which element is capable of decreasing a volume filled with printing ink by a specific percentage at high speed when a voltage is applied. As a result, printing ink is displaced and is ejected by a nozzle that is connected to the volume filled with printing ink, forming at least one droplet of printing ink. The adjustment path of the piezoelectric element and therefore the decrease in volume and therefore the size of the printing ink droplets can be influenced by applying different voltages to the piezoelectric element. Color gradations can thereby be produced in the resulting printed image, without adjusting the number of droplets that contribute to forming the printed image (amplitude modulation). It is also possible to use at least one heating element per nozzle, which produces a gas bubble at high speed in a volume filled with printing ink by evaporating printing ink. The additional volume of the gas bubble displaces printing ink, which is in turn ejected by the corresponding nozzle and forms at least one droplet of printing ink.

In the drop-on-demand method, a deflection of droplets after being ejected from the corresponding nozzle is not necessary because it is possible to define a target position for the respective printing ink droplet on the moved printing material web 02 with respect to the circumferential direction of the at least one first central cylinder 201, solely on the basis of the emission time of said printing ink droplet and the rotational speed of the first central cylinder 201 and/or on the basis of the rotational position of the first central cylinder 201. By controlling each nozzle separately, droplets of printing ink are transferred by the at least one print head 212 onto the printing material web 02 only at selected times and at selected locations. This is carried out on the basis of the rotational speed and/or the rotational angle position of the at least one first central cylinder 201, the distance between the respective nozzle and the printing material web 02 and the position of the target region of the respective nozzle with respect to the circumferential angle. This results in a desired printed image, which is constructed on the basis of the actuation of all nozzles.

As described above, the first drive motor 208 of the first central cylinder 201 is preferably connected to the machine controller in terms of circuitry such that the machine controller is informed at all times as to the rotational position of the first drive motor 208, and therefore likewise as to the rotational position of the first central cylinder 201, on the basis of the target data about the rotational position of the first drive motor 208, provided by the machine controller to the first drive motor 208 of the first central cylinder 201. Ink droplets are then ejected from the at least one nozzle of the at least one print head 212 on the basis of the rotational position of the first drive motor 208 defined by the machine controller. The target data about the rotational position of the first drive motor 208, provided by the machine controller to the first drive motor 208, are preferably included in real time in the calculation of data for controlling the nozzles of the at least one print head 212. A comparison with actual data about the rotational position of the first drive motor 208 preferably is not necessary, and preferably is not carried out.

The first printing unit 200 preferably has at least one storage tank for each printing ink to be processed This at least one storage tank preferably has a volumetric capacity of 10 liters to 100 liters. Preferably at least one, and more preferably each, of these storage tanks is connected via at least one line to at least one buffer storage tank. The at least one buffer storage tank preferably has a volumetric capacity of 1 liter to 10 liters. Based on the volume of printing ink located in the at least one buffer storage tank, it is possible to replace one or more storage tanks without interrupting an ongoing print operation. At least one, and more preferably each, of these buffer storage tanks is preferably connected via at least one additional line, referred to as a supply line, to at least one intermediate storage tank. The at least one intermediate storage tank preferably has a volumetric capacity of 0.1 liter to 1 liter. The at least one intermediate storage tank is connected to the at least one print head 212. One pair of intermediate storage tanks is preferably assigned to each double row of print heads 212. At least one preparation device is preferably arranged between the at least one storage tank and the at least one print head 212, and more preferably between the at least one storage tank and the at least one intermediate storage tank, and can preferably be used to remove soil and/or gas bubbles from corresponding printing ink.

The at least one intermediate storage tank is preferably situated above the print head 212 that cooperates with the respective intermediate storage tank. A difference in height between the at least one print head 212 and the respective at least one intermediate storage tank is preferably the same for multiple and more preferably for all the print heads 212. This serves to ensure that the hydrostatic pressure of the printing ink, existing in the at least one print head 212, is the same for each print head 212, and therefore, the same operating conditions are in effect for all print heads 212. At least the at least one supply line which connects the at least one intermediate storage tank to the at least one print head 212 is preferably acted on and/or can be acted on by a negative pressure. This serves to prevent printing ink from unintentionally exiting the at least one print head 212, for example. Each print head 212 also preferably has at least one drainage line, through which dried or soiled printing ink can preferably be removed from the at least one print head 212, without being ejected through a nozzle that is provided for printing. The at least one drainage line is preferably connected to at least one waste receptacle.

The alignment of the printing material web 02 by means of the web edge aligner 114, and optionally by means of the first impression roller 206 of the first printing unit 200, and the large wrap angle of the printing material web 02 around the at least one first central cylinder 201, and optionally additional devices such as carriers serve to ensure that the printing material web 02 is arranged without slip in a precisely defined position on the outer cylinder surface of the at least one first central cylinder 201, and also remains in said position until the specific release thereof at the end of the region of the wrap angle. The contact of the printing material web 02 with the outer cylinder surface of the at least one first central cylinder 201 also prevents or at least reduces to a sufficient degree the swelling of the printing material web 02, at least in the transport direction of the printing material web 02 and at least for the duration of contact of a respective region of the printing material web 02 with the outer cylinder surface of the at least one first central cylinder 201, even following contact with printing ink droplets. It is thereby ensured that printing ink droplets from different print heads 211 are applied to a printing material web 02 that is arranged in a uniformly defined manner. The precise and constant positioning of the printing material web 02 relative to the at least one first central cylinder 201 is of great importance to precise color registration and/or a true-to-register printed image, particularly if the actuation of the at least one nozzle is linked to the rotational position of the first central cylinder 201, as described above.

The nozzles of the at least one print head 212 are arranged such that the distance between the nozzles and the printing material web 02 arranged on the outer cylinder surface of the at least one first central cylinder 201 preferably measures between 0.5 mm and 5 mm, and more preferably between 1 mm and 1.5 mm The high angular resolution and/or the high sampling frequency of the rotational angle sensor and/or the high precision of the target data about the rotational position of the first drive motor 208 of the first central cylinder 201, defined by the machine controller and processed on the first drive motor 208 of the first central cylinder 201, enables a highly precise position determination and/or knowledge about the position of the printing material web 02 relative to the nozzles and the target regions thereof. A droplet flight time between the nozzles and the printing material web 02 is known, for example, based on a learning process and/or based on the known distance between the nozzles and the printing material web 02 and a known droplet velocity. From the rotational angle position of the at least one first central cylinder 201 and/or of the first drive 208 of the at least one first central cylinder 201, the rotational speed of the at least one first central cylinder 201 and the droplet flight time, the ideal time for ejection of a respective droplet is determined, so that a precise color registration and/or true-to-register printing of the image on the printing material web 02 is achieved.

At least one sensor embodied as a first printing image sensor is preferably provided, more preferably arranged at a position downstream of the first printing element 211 along the transport path of the printing material web 02. The at least one first printed image sensor is embodied, for example, as a first line camera or as a first surface camera. The at least one first printed image sensor is embodied, for example, as at least one CCD sensor and/or as at least one CMOS sensor. By means of this at least one first printed image sensor and a corresponding evaluation unit, for example, the higher-level machine controller, the actuation of all the print heads 212 and/or double rows of print heads 212 of the first printing element 211, arranged one in front of the other in the circumferential direction of the at least one first central cylinder 201, is monitored and controlled. In a first variant of the at least one printed image sensor, only one first printed image sensor is provided, the sensor field of which encompasses the entire width of the transport path of the printing material web 02. In a second variant of the at least one printed image sensor, only one first printed image sensor is provided, which is embodied as movable in the direction A, orthogonally to the direction of the transport path of the printing material web 02. In a third variant of the at least one printed image sensor, a plurality of printed image sensors are provided, the respective sensor fields of which each encompass different regions of the transport path of the printing material web 02. These regions are preferably arranged offset from one another in the direction A, orthogonally to the direction of the transport path of the printing material web 02. The totality of the sensor fields of the plurality of printed image sensors preferably encompasses the total width of the transport path of the printing material web 02.

The positioning of image points which are formed by droplets of printing ink that come from a respectively first print head 212 is compared with the positioning of image points which are formed by droplets of printing ink, each of which comes from a second print head 212 that lies downstream of the respective first print head 212 in the circumferential direction of the at least one first central cylinder 201. This is preferably carried out regardless of whether these respectively first and second print heads 212, disposed and/or acting one in front of the other in the circumferential direction of the at least one first central cylinder 201, process the same or a different printing ink. The coordination of the positions of the printed images that come from different print heads 212 is monitored. When the same printing ink is used, a true-to-register merging of partial images is monitored. When different printing inks are used, color registration or color register is monitored. A quality control of the printed image preferably is also carried out on the basis of the measured values from the at least one printed image sensor.

Depending on the speed with which the individual nozzles can be actuated and operated, the printing material web 02 might need to be imprinted multiple times with the same printing ink until the desired result can be achieved. For this purpose, at least two double rows of print heads 212, disposed one in front of the other in the circumferential direction of the first central cylinder 201, are preferably assigned to each printing ink. Therefore, with a transport speed of the printing material web of 2 m/s and a four-color printing process, a resolution of 600 dpi (600 dots per inch) is achieved. Even higher web speeds of 150 m per minute or more are preferably possible. Lower resolutions and/or fewer colors enable correspondingly higher transport speeds. More particularly, rather than a four-color printing process, a two-color printing process can be implemented when, for example, half the print heads 212 are assigned to each of the two colors. In that case, printing speed can be doubled, for example. A greater number of print heads 212 is a further option for influencing the print resolution and/or transport speed and/or color selection that can be achieved. More particularly, a sufficiently high data processing speed of the controller that controls the print heads 212 must be ensured.

During regular printing operation, all print heads 212 are fixedly arranged. A consistently precise color registration and/or true-to-register alignment of all nozzles is thereby ensured. Various situations are conceivable, in which a movement of the print heads 212 may be necessary. A first such situation is a flying roll change or generally a roll change involving a splicing process. In such processes, a printing material web 02 is connected by means of an adhesive strip to another printing material web 02. This results in a splice, which must pass through the entire transport path of the printing material web 02. The thickness of this splice, that is, the minimum dimension thereof, is greater than the thickness of the printing material web 02. Essentially, the splice is as thick as two printing material webs 02 plus the adhesive strip. This can result in difficulties when the splice passes through the gap between the nozzles of the print heads 212 and the outer cylinder surface of the at least one first central cylinder 201. The at least one nozzle bar 213 is therefore movable in a radial direction relative to the rotational axis 207 of the at least one first central cylinder 201. This allows the distance to be increased sufficiently, however it must later be decreased again accordingly. A second such situation involves, for example, the maintenance of at least one of the print heads 212. The print heads 212 are preferably mounted individually on the at least one nozzle bar 213 and can be individually detached from the at least one nozzle bar 213. This allows individual print heads 212 to be maintained and/or cleaned and/or replaced.

If multiple nozzle bars 213 are arranged so as to be movable relative to one another, when at least one nozzle bar 213 is returned to a printing position, minimal incorrect positions of nozzle bars 213 relative to one another can occur. It can thus become necessary to implement an alignment, particularly of all print heads 212 of one nozzle bar 213 to print heads 212 of other nozzle bars 213. When a new print head 212 and/or a print head to be repositioned is mounted on the at least one nozzle bar 213 on which at least one other print head 212 is already mounted, a precisely matching alignment of this new print head 212 or print head to be repositioned with the at least one already mounted print head 212, specifically in the circumferential direction and/or in the axial direction A with respect to the at least one first central cylinder 201, will not necessarily occur, and will occur coincidentally at best. Thus in this case as well, an alignment may be necessary, particularly of an individual print head 212 in relation to other print heads 212 of the same nozzle bar 213 and/or other nozzle bars 213.

At least one sensor detects the position of the target region of at least one new print head 212 or print head to be repositioned relative to the position of the target region of at least one print head 212 that is already mounted. This is preferably accomplished on the basis of a comparison of the positions of image points produced by the respective print heads 212 on the printing material web 02. The above-described at least one first printed image sensor is preferably used as the sensor for this purpose. However, it is also possible to use another sensor, different from the above-described at least one first printed image sensor for this purpose, for example, a sensor that is specialized for this task. These relative positions are evaluated by an evaluation unit, for example, the higher-level machine controller. An installation position of the at least one new and/or repositioned print head 212 in the circumferential direction with respect to the at least one first central cylinder 201 can be compensated for by actuating the nozzles of this print head 212, preferably similarly to the above-described adjustment of print heads 212 in different double rows of print heads 212. An installation position of the at least one new and/or repositioned print head 212 in the axial direction A with respect to the at least one first central cylinder 201 is compensated for by means of at least one adjustment mechanism. Preferably, a plurality of print heads 212 each has its own integral adjustment mechanism, and more preferably, all print heads 212 each have their own integral adjustment mechanism. It is conceivable for a print head 212 to be used as a reference, according to which all other print heads 212 are aligned. This print head 212 used as a reference then does not require an integral adjustment mechanism. Each such adjustment mechanism has at least one linear drive, which is preferably embodied as an electric motor and more preferably as a stepper motor. For example, the linear drive has a spindle drive and/or a toothed rack and a pinion gear. In another variant, the linear drive has an eccentric element and a groove that cooperates with said element. Each print head 212 that has a linear drive is arranged so as to move preferably at least parallel to the axial direction A by means of said linear drive.

Once at least one print head 212 has been installed, a test printing is preferably run, in which the new print head 212 or print head to be repositioned and at least one print head 212 that serves as a reference transfer droplets of printing ink onto the printing material web 02. The test printing is preferably detected automatically by means of a sensor, for example, the first printed image sensor. In the event of a deviation in an actual position of the at least one new and/or repositioned print head 212, detected by way of the test printing, the position of this print head 212 is preferably adjusted automatically in the axial direction A by means of the adjustment mechanism, and/or the actuation of the nozzles of this print head 212 is adjusted with respect to a droplet ejection time. The test printing can be embodied, for example, in the form of a test strip that extends across part of or the entire axial width of the printing material 02. Such test printings and particularly test strips are preferably also at least partially imprinted onto the printing material web 02 during an ongoing printing operation, for example, in a region between two printed images which represents an edge region during the production of finished printed products which will be cut off anyway, particularly regardless of whether or not a test printing is located thereon. The at least one sensor then registers the printed image of the at least one test printing. More particularly, several such test printings can be detected in temporal succession by means of a sensor, which is moved in each case to different axial positions in order to examine the position of the image points there.

The at least one nozzle bar 213 is preferably arranged so as to move in the axial direction A, preferably far enough that no nozzle of the nozzle bar 213 and/or no operating range of a print head 211 of the nozzle bar 213 is in the same position with respect to the axial direction A as any component of the body of the at least one first central cylinder 201. At least one linear guide is preferably provided for this purpose. A sliding carriage that supports the at least one nozzle bar 213 is arranged so as to move along the at least one linear guide. To perform maintenance on the printing element 211, the at least one nozzle bar 213 is preferably first disengaged from the at least one first central cylinder 201 in a direction oriented radially to the rotational axis 207 of the at least one first central cylinder 201, and is then moved in the axial direction A. A protective cover is preferably provided, which can be moved into a position relative to the at least one nozzle bar 213 in which the protective cover is arranged so as to cover all the nozzles of the at least one nozzle bar that has been disengaged from the at least one first central cylinder 201. The nozzles are thereby prevented from drying out. In this position, both the nozzles of the at least one nozzle bar 213 and the protective cover are preferably located in the region of the body of the at least one first central cylinder 201, with respect to the axial direction A. More preferably, in this position the at least one nozzle bar 213 and the protective cover delimit an air-tight sealed volume within which the nozzle openings are located.

At least one nozzle cleaning device is preferably provided, which has a row of washing nozzles and/or brushes and/or strippers. This at least one nozzle cleaning device is preferably movable in the axial direction A and/or is movable from below up to the nozzles of the at least one nozzle bar 213. Additionally or alternatively, the at least one nozzle bar 213 can be moved from above up to the nozzle cleaning device. The at least one nozzle cleaning device is preferably connected to the protective cover and/or movable together with the protective cover, for example, in the axial direction A. Preferably, however, the at least one nozzle cleaning device is also movable relative to the protective cover, for example, to allow the at least one nozzle cleaning device to be removed from the sealed volume. The protective cover preferably serves simultaneously as a collecting tank for cleaning fluid and/or soil and/or printing ink that exits the washing nozzles and/or that drips from the nozzles. The at least one nozzle bar 213 is movable entirely independently of those components of the printing machine 01 that are arranged in contact with the printing material web 02. Therefore, a cleaning and/or maintenance process of this type can be carried out without impacting the printing material web 02, and particularly without having to remove the printing material web 02 from the printing machine 01.

The at least one print head 212 and/or the nozzles thereof can preferably be cleaned in a first and/or a second method. In the first type of cleaning, printing ink is conveyed through the nozzles of the at least one print head 212, preferably with the negative pressure switched off and/or under increased pressure, preferably in a volume that is sufficient to carry along contaminants and/or dried printing ink and to preferably pass these into the protective cover that serves as a collecting tank. Said tank can preferably be closed off by a separate closure element which is different from the at least one nozzle bar 213, and can be cleaned separately, particularly rinsed. The first type of cleaning is the preferred type of cleaning. The second type of cleaning is implemented in the case of heavier soiling, for example. In this case, the entire at least one print head 212 and the supply lines thereof, and preferably also the respective intermediate storage tanks are fully freed of printing ink and then rinsed with a cleaning fluid. This cleaning fluid, in turn, is preferably collected by means of the protective cover that serves as a collecting tank. This procedure is associated with a greater loss of printing ink, but offers the advantage of a particularly intensive cleaning.

Once the printing material web 02 has passed through the at least one first printing unit 200, the printing material web 02 is transported further along its transport path, and is preferably fed to the at least one first dryer 301 of the at least one first dryer unit 300. The at least one first dryer 301 is accordingly arranged downstream of the first printing element 211 and particularly downstream of the at least one first printing unit 200 with respect to the transport path of the printing material web 02. The first side of the printing material web 02, which is imprinted by the at least one first printing unit 200, is preferably not in contact with any component of the web-fed printing machine 01 between a last point of contact of the printing material web 02 with the at least one first central cylinder 201 of the at least one first printing unit 200 and an area of action of the at least one first dryer 301. The second side of the printing material web 02, which is not imprinted by the first printing unit 200 and is in contact with the at least one first central cylinder 201 of the at least one first printing unit 200, is preferably in contact with at least one deflecting roller 214 of the at least one first printing unit 200 and/or with at least one deflecting roller 312 of the at least one first dryer 301 between the last point of contact of the printing material web 02 with the first central cylinder 201 of the at least one first printing unit 200 and the area of action of the at least one first dryer 301.

The at least one deflecting roller 214 of the first printing unit 200 is preferably provided, and further preferably deflects the printing material web 02, once said web has been released from the at least one first central cylinder 201 in a direction having a greater, preferably downward-directed vertical component than an optionally existing horizontal component, into a direction having a greater horizontal component than an optionally existing vertical component. In this case, only the second side of the printing material web 02, which has not been imprinted by the first printing unit 200, is in contact with this at least one deflecting roller 214 of the first printing unit 200. At least one third measuring device 214, preferably embodied as a third measuring roller 214, is provided. This third measuring device 214 is used for measuring web tension. Further preferably, the at least one deflecting roller 214 of the first printing unit 200 is identical to the third measuring device 214 embodied as a third measuring roller 214. At least one deflecting roller 312 of the at least one first dryer 301 is preferably provided, which deflects the printing material web 02 from this direction or another direction having a greater horizontal component than an optionally existing vertical component into a direction having a greater, preferably upwardly oriented vertical component than an optionally existing horizontal component. In this case, only the second side of the printing material web 02, which has not been imprinted by the first printing unit 200, is in contact with the at least one deflecting roller 312 of the at least one first dryer 301.

The at least one first dryer 301 is preferably embodied as an infrared radiation dryer 301. The at least one first dryer 301 preferably has at least one and preferably multiple, more preferably at least six and more preferably still at least ten radiation sources 302, preferably embodied as infrared radiation sources 302, arranged one in front of the other in the transport direction of the printing material web 02. In this case, a radiation source 302, preferably an infrared radiation source 302, is a device by means of which electrical energy is converted and/or can be converted to radiation, preferably infrared radiation, which is directed and/or can be directed toward the printing material web 02. The at least one radiation source 302 preferably has a defined area of action. More particularly, the area of action of each radiation source 302 is the area that contains all the points that can be connected, directly or via reflectors, to the radiation source 302 in a straight line. The area of action of the at least one first dryer 301 is comprised of the areas of action of all radiation sources 302 of the at least one first dryer 301. The area of action of the at least one first dryer 301 preferably points from the at least one radiation source 302 to a part of the transport path of the printing material web 02 that is closest to the at least one radiation source 302.

The at least one radiation source 302 has a length and a width and a height. The length of the radiation source 302 is at least five times the size of the width and the height of the radiation source 302. The length of the at least one radiation source 302 preferably extends in the axial direction A, parallel to the rotational axis 207 of the at least one first central cylinder 201, and therefore in the direction A of the width of the printing material web 02. This means that the at least one first dryer 301 has at least one radiation source 302, which extends in a horizontal direction A, oriented orthogonally to the transport path of the printing material web 02 through the at least one first dryer 301. The arrangement of multiple radiation sources 302 thus oriented, one in front of the other in the direction of transport of the printing material web 02 allows the radiation output delivered as a whole onto the printing material web 02 to be adjusted to an ink volume and/or ink density applied to the printing material web 02.

The at least one radiation source 302 preferably has at least one and more preferably two tubes, the diameters of which preferably measure between 10 mm and 50 mm. The at least one tube is preferably made of a material that is at least partially permeable to radiation in the infrared range, more preferably a quartz glass. At least one incandescent element, preferably an incandescent coil or an incandescent strip, preferably made of wolfram and/or a wolfram alloy and/or carbon, is provided in the interior of each such tube. The incandescent element can be made of wolfram carbide, for example. A reflective coating is preferably applied to a side of the tube that faces away from the printing material web 02. The incandescent elements act as heating resistors, which produce heating and a heat output when acted on by a flow of current. Each radiation source 302 has a housing 316, which preferably has a plurality of venting openings, and which preferably is not situated between the incandescent elements and the printing material web 02. All the venting openings preferably lead to a common air removal line 318.

In one variant, which is preferably identical to the variant described above and in the following, with the exception of the alignment of the at least one radiation source 302, the length of the at least one radiation source 302 is aligned parallel to the direction of transport of the printing material web 02. A plurality of radiation sources 302 are then preferably arranged side by side in the direction A of the width of the printing material web 02. This means that the at least one first dryer 301 has at least one radiation source 302 which extends in a direction having at least one component oriented parallel to the transport path of the printing material 02 through the at least one first dryer 301. This allows printing material webs 02 of different widths to be dried in an optimized fashion, without expending an unnecessary amount of power and/or without risking overheating of the at least one first dryer 301. Dryer output can be adjusted via a preferably individual adjustment of the radiation output of the at least one radiation source 302.

However, the plurality of radiation sources 302 are preferably arranged parallel to one another with respect to their length. The plurality of radiation sources 302 are preferably arranged side by side in a direction which is aligned orthogonally to the length of the radiation sources 302 and/or which extends along the transport path of the printing material web 02. Therefore, a plurality of radiation sources 302 each preferably extend orthogonally to the direction of transport of the printing material web 02 and are arranged one in front of the other, viewed in the direction of transport of the printing material web 02. As a result of the radiation output by the at least one radiation source 302, moisture is removed from the printing material web 02 and/or from the printing ink located thereon, and is absorbed by the ambient air in the interior of the at least one first dryer 301. The transport path of the printing material web 02 extends through this interior of the at least one first dryer 301. To achieve a consistently high drying performance, a temperature control of the components of the at least one first dryer 301 and/or a ventilation of the interior of the at least one first dryer 301 is ensured. For this purpose, at least one temperature control device is preferably arranged in the region of the at least one radiation source 302. In one preferred variant, the temperature control device is embodied as a ventilating device. The ventilating device preferably also serves to remove moisture from the at least one first dryer 301.

The ventilating device has at least one air infeed line 317, at least one ventilation opening 313 connected thereto, an air removal line 318, and at least one venting opening connected thereto. Air flows through the at least one ventilation opening 313 in a direction toward the interior of the at least one dryer 301. The at least one first dryer 301 is therefore likewise embodied as an air flow dryer 301, in addition to being embodied as a radiation dryer 301. Alternatively or additionally, the at least one first dryer 301 is embodied as a UV radiation dryer 301 and/or as a pure air flow dryer 301, for example, a hot air dryer 301. At least one preferably slit-shaped ventilation opening 313 is preferably provided. Further preferably, at least one preferably slit-shaped ventilation opening 313 is arranged at least between two radiation sources 302 and more preferably still between every two radiation sources 302. The housing 316 of at least one and preferably each radiation source 302 preferably has at least one venting opening, and more preferably, a plurality of venting openings.

In one variant, such a temperature control device has at least one fluid temperature-controlled, preferably liquid temperature-controlled component, which is preferably arranged at a maximum distance of 50 cm, more preferably a maximum distance of 15 cm from the at least one radiation source 302. Such a fluid temperature-controlled component is arranged in the area of action of the at least one first dryer 301, for example. Such a fluid temperature-controlled component is a printing material guide element, such as a printing material deflector plate, for example, which has at least one line through which temperature control fluid, and preferably temperature control liquid, flows and/or can flow, and is connected to such a line. Alternatively or additionally, in one variant, at least part of the housing 316 of at least one and preferably each radiation source 302 has at least one line through which temperature control fluid and preferably temperature control liquid flows and/or can flow, and/or is connected to such a line. Water is used as the temperature control fluid, for example.

Air is conducted through the at least one ventilation opening 313 into the interior of the at least one first dryer 301. A positive pressure is preferably present in the first dryer 301. Inside the first dryer 301, water and/or solvent from the printing inks which is to be removed from the printing material web 02 is removed by the infrared radiation and is absorbed by the introduced air. This air is then removed from the at least one first dryer 301 through the at least one venting opening. By removing this air which has absorbed the excess water and/or solvent, a saturation of the air located inside the first dryer 301 with water and/or solvent is avoided, while at the same time, additional thermal energy is removed from the interior of the dryer 301. This increases the efficacy of the first dryer 301 and the lifespan of the radiation sources 302.

The at least one ventilation opening 313 is preferably situated upstream of the at least one air infeed line 317, and the at least venting opening is situated downstream of the at least one air removal line 318. At least one pumping device, for example, a pump, is preferably connected to the at least one air infeed line 317, and more preferably, is also at least indirectly connected to the at least one air removal line. At least one controllable, and more preferably, adjustable gas valve is preferably provided. This at least one gas valve is preferably manually adjustable and/or coupled to a drive and/or motor operated, and is preferably embodied as a branch having at least one damper. A first line, connected to the intake of the at least one gas valve, is preferably the at least one air removal line 318. A second line connected to the outlet of the at least one gas valve preferably leads, for example, to a disposal device and/or a recycling device. A third line connected to an outlet of the at least one gas valve preferably leads to the at least one pumping device. At least one additional line, for example, a fresh air line, also leads to the at least one pumping device.

The amount of air which is removed from the at least one first dryer 301, and which is preferably returned by means of the at least one pumping device to the at least one first dryer 301, can be adjusted by means of the at least one gas valve. The at least one gas valve is preferably adjusted such that the percentage of air flowing through the first line that is connected to the at least one gas valve, which can preferably be adjusted between 0% and 100%, is transported to the third line that is connected to the at least one gas valve, and is therefore transported back to the at least one first dryer 301 via the at least one pumping device and the at least one air infeed line 317. The remaining air that is removed is fed to the second line, which is connected to the at least one gas valve, and is removed. Thus the at least one gas valve determines the percentage that is fed to the air infeed line 317 and the percentage that is removed as exhaust air from a gas stream flowing through the air removal line 318. As a result of this removal, negative pressure is created, which is preferably automatically compensated for by transporting additional air via the fresh air line, preferably first into the at least one pumping device and into the at least one first dryer 301. The negative pressure itself preferably ensures the suctioning of the necessary volume of air through the fresh air line. The efficacy of the at least one first dryer 301 is thereby improved, since exhaust air that is not completely saturated is reused, resulting in a saving of thermal energy due to the reintroduction of hot exhaust air. On the other hand, when the necessary preparation measures are implemented, the volume of air to be purified is decreased.

The at least one ventilation opening 313 and/or the at least one air infeed line 317 and/or the at least one venting opening and/or the at least one air removal line 318 and/or the at least one pumping device and/or the at least one gas valve and/or the at least one second line, which is connected to the at least one gas valve, and/or the at least one disposal device and/or recycling device and/or the at least one third line and/or fresh air line, which is connected to the at least one gas valve, are preferably components of a ventilating device of the at least one first dryer 301. More particularly, this means that the at least one first dryer 301 preferably has the at least one ventilating device, and that the at least one ventilating device comprises the at least one air infeed line 317, which leads to the at least one first dryer 301, and the at least one air removal line 318, which leads away from the at least one first dryer, and the at least one pumping device, which is preferably drivable and/or driven, for example, by means of an electric drive, and that the at least one air removal line 318 is coupled and/or can be coupled via the at least one pumping device to the at least one air infeed line 317. An air infeed line 317 that leads to the at least one first dryer 301 is particularly understood in this case as a line 317, the interior of which is connected to the interior of the at least one first dryer 301, and through the interior of which, during operation of the at least one first dryer 301, a gas flows in the direction of the interior of the at least one dryer 301. An air removal line 318 that leads away from the at least one first dryer in this case is particularly a line 318, the interior of which is connected to the interior of the at least one first dryer 301, and through the interior of which, during operation of the at least one first dryer 301, a gas flows in the direction away from the interior of the at least one dryer 301.

The transport path of the printing material web 02 through the at least one first dryer 301 and particularly through the area of action of the at least one first dryer 301 preferably has a greater vertical component than an optionally existing horizontal component. More preferably, the transport path of the printing material web 02 extends through the at least one first dryer 301 upward in a substantially vertical direction. This serves to ensure that, in the event of a web break, no part of the printing material web 02 will drop from above onto a radiation source 302 and/or come to rest on a radiation source 302. This prevents the printing material web 02 from igniting on the hot radiation sources 302. At least one first support roller 319 is preferably arranged in the interior of the at least one first dryer 301 along the transport path, more preferably such that the at least one first support roller 319 is shielded from the radiation sources 302 by the printing material web 02. The at least one first support roller 319 prevents any uncontrolled flapping of the printing material web 02, which might otherwise be caused by the air flowing out of the at least one ventilation opening 313. A wrap angle of the printing material web 02 around the at least one first support roller 319 preferably measures between 1° and 45°, more preferably between 1° and 25°.

At least one first cooling device 303 is preferably arranged downstream of the area of action of the at least one radiation source 302 of the at least one first dryer 301 in the direction of transport of the printing material web 02. The at least one first cooling unit 303 has at least one first cooling roller 304 and preferably has a first cooling impression roller 306 that can be engaged and/or is engaged against the at least one first cooling roller 304, and preferably has at least one deflecting roller 307; 308 that can be engaged and/or is engaged against the at least one first cooling roller 304. The first cooling impression roller 306 preferably has an outer surface which is made of a flexible material, for example, an elastomer. A first drive motor 311, embodied as a first cooling roller drive motor 311 and dedicated to the at least one first cooling roller 304, and the first cooling impression roller 306 are preferably part of a web tension adjustment system, that is, are arranged so as to adjust web tension and for this purpose are preferably at least partially and/or temporarily connected to the higher-level machine controller. The at least one first cooling roller 304 preferably represents at least one fourth motor-driven rotating body 304. After leaving the area of action of the first dryer 301, the printing material web 02 first wraps around a first deflecting roller 307, and preferably passes through a roller nip between the first deflecting roller 307 and the at least one first cooling roller 304. On its continued path, the printing material web 02 wraps around the at least one first cooling roller 304 with a wrap angle of preferably at least 180° and more preferably at least 270°. This means that part of an outer surface of the at least one first cooling roller 304, provided as a contact surface between the at least one first cooling roller 304 and the printing material web 02, has a wrap angle around the at least one first cooling roller 304 which preferably measures at least 180° and more preferably at least 270°. This results in a particularly effective cooling of the printing material web 02 and therefore also enables high dryer outputs.

The first cooling impression roller 306 and the at least one first cooling roller 304 together form a first cooling roller nip 309, in which the printing material web 02 is located and/or through which the printing material web 02 passes. In this case, the printing material web 02 is pressed by the cooling impression roller 306 against the at least one first cooling roller 304. On its continued path, the printing material web 02 preferably wraps around a second deflecting roller 308 of the at least one first cooling unit 303. The at least one first cooling roller 304 of the at least one first cooling unit 303 is preferably embodied as a cooling roller 304 through which a coolant flows. This means that coolant flows and/or can flow through at least part of the body of the at least one first cooling roller 304. The coolant is preferably a cooling fluid, for example, water. In a preferred variant, a fluid circuit is connected with both the at least one first cooling unit 303 and the optionally provided second cooling unit 333, and with the temperature control device of the at least one radiation source 302. The first cooling roller 304 preferably has an integral first cooling roller drive motor 311.

At least one second printing unit 400 is arranged downstream of the at least one first cooling unit 303 along the transport path of the printing material web 02. At least one second web edge aligner, which is preferably embodied as manually or automatically controllable and/or adjustable, is preferably situated immediately upstream of the at least one second printing unit 400 and preferably downstream of the at least one first dryer 301, and particularly downstream of the at least one first printing unit 200, along the transport path of the printing material web 02. The at least one second printing unit 400 is similar in configuration to the first printing unit 200. The at least one second printing unit 400 is preferably substantially and more preferably fully symmetrical to the at least one first printing unit 200 in terms of the described components. A corresponding plane of symmetry has a horizontal surface normal which is oriented orthogonally to the axial direction A. More particularly, the second printing unit 400 has a second central printing cylinder 401, or central cylinder 401, which is wrapped by the printing material web 02 during printing operation, likewise at a wrap angle of preferably at least 180° and more preferably at least 270°. Accordingly, during printing operation, preferably at least 50% and more preferably at least 75% of an outer cylinder surface of the second central cylinder 401, viewed in the circumferential direction, is in contact with the printing material web 02.

The second central cylinder 401 preferably represents a fifth motor-driven rotating body 401. The direction of rotation of the second central cylinder 401 of the second printing unit 400 is preferably opposite the direction of rotation of the at least one first central cylinder 201. Along the transport path of the printing material web 02, upstream of the second central cylinder 401 of the second printing unit 400, a second printing material cleaning device 402 or web cleaning device 402 is preferably arranged so as to act on the printing material web 02. The second printing material cleaning device 402 is preferably embodied as a second dust removal device 402. The second printing material cleaning device 402 preferably has at least one brush and/or at least one vacuum device and/or a device for electrostatically charging particles that adhere to the printing material web 02. The second printing material cleaning device 402 is assigned to at least one second side of the printing material web 02, particularly aligned so as to act and/or be capable of acting at least on this second side of the printing material web 02. If the first printing material cleaning device 202 is embodied as acting and/or capable of acting on both sides of the printing material web 02, the second printing material cleaning device 402 can be dispensed with.

A roller 403 of the second printing unit 400, embodied as a second deflecting roller 403, is arranged parallel to the second central cylinder 401 and spaced therefrom by a second gap 404. The transport path of the printing material web 02 through the at least one second printing unit 400 extends similarly to the transport path through the at least one first printing unit 200. More particularly, the printing material web 02 preferably wraps around part of the second deflecting roller 403 and is deflected by said roller such that the transport path of the printing material web 02 in the second gap 404 extends both tangentially to the second deflecting roller 403 and tangentially to the second central cylinder 401. At least one cylinder 406 embodied as a second impression roller 406 is preferably arranged in the second printing unit 400. The second impression roller 406 preferably has an outer surface which is made of a flexible material, for example, an elastomer. The second impression roller 406 is preferably structured and arranged similarly to the first impression roller 206, particularly in terms of its movability and in terms of a second impression roller nip 409. A plane that contains both a rotational axis 407 of the second central cylinder 401 and a rotational axis of the second impression roller 406 has a surface normal which deviates from horizontal by a maximum of 20° and more preferably by a maximum of 10°. More preferably, the rotational axis of the second impression roller 406 is positioned below the rotational axis of the first central cylinder 201.

The second central cylinder 401 is preferably arranged and structured similarly to the first central cylinder 201, particularly with respect to a second drive motor 408 of the second central cylinder 401 and a corresponding, preferably arranged second rotational angle sensor, which is embodied as measuring and/or capable of measuring a rotational angle position of the second drive motor 408 and/or the second central cylinder 401, and as transmitting and/or capable of transmitting this to the higher-level machine controller. The printing material web 02 is placed flat and preferably in a clear and known position against the second central cylinder 401 by the second deflecting roller 403 and/or preferably by the second impression roller 406. More particularly, the second drive motor 408 is preferably embodied as an electric motor 408, and more preferably as a direct drive 408 of the second central cylinder 401. The second drive motor 408 of the second central cylinder 401 is preferably embodied as a synchronous motor 408.

The second rotational angle sensor is preferably likewise embodied as a rotary encoder or absolute value encoder, for example, so that a rotational position of the second drive motor 408 and/or preferably a rotational position of the second central cylinder 401 can preferably be absolutely determined by means of the higher-level machine controller. The second drive motor 408 of the second central cylinder 401 is preferably positioned at a first axial end of the second central cylinder 401, referred to the rotational axis 407 of the second central cylinder 401, whereas the rotational angle sensor is preferably positioned at a second axial end of the second central cylinder 401, referred to the rotational axis 407 of the second central cylinder 401. The rotational angle sensor preferably likewise has a particularly high resolution, for example, a resolution of at least 3,000 (three thousand) and preferably at least 10,000 (ten thousand) increments per round angle (360°) and more preferably at least 100,000 (one hundred thousand) increments per round angle) (360°. The rotational angle sensor preferably has a high temporal sampling frequency.

Additionally or alternatively, the second drive motor 408 of the second central cylinder 401 is likewise connected to the machine controller in terms of circuitry such that the machine controller is informed at all times as to the rotational position of the second drive motor 408, and therefore likewise as to the rotational position of the second central cylinder 401, on the basis of target data about the rotational position of the second drive motor 408, provided by the machine controller to the second drive motor 408 of the second central cylinder 401. More particularly, a region of the machine controller that defines the rotational angle position or rotational position of the second central cylinder 401 and/or of the second drive motor 401 is connected directly, particularly without an interconnected sensor, to a region of the machine controller that controls the at least one print head 412 of the second printing unit 400.

In the second printing unit 400, at least one second printing element 411, embodied as an inkjet printing element 411 or also as an ink-jet printing element 411, is arranged downstream of the second impression roller 406, aligned toward the second central cylinder 401, in the direction of rotation of the second central cylinder 401 and therefore along the transport path of the printing material web 02. The at least one second printing element 411 of the at least one second printing unit 400 is preferably identical to the at least one first printing element 211 of the at least one first printing unit 200, particularly with respect to at least one nozzle bar 413, at least one print head 412 embodied as an inkjet print head 412 and the arrangement thereof in double rows, the execution and resolution of the printing method, the arrangement, alignment and actuation of the nozzles and the movability and adjustability of the at least one nozzle bar 413 and the at least one print head 412 by means of at least one adjustment mechanism having a corresponding electric motor. A similar protective cover and/or cleaning device is also preferably provided. A proper alignment of the print heads 412 of the at least one second printing unit 400 is also preferably verified by at least one sensor detecting a printed image and the machine controller evaluating this printed image. This at least one sensor is preferably at least one second printed image sensor, which is similar in embodiment to the at least one first printed image sensor. The at least one second printing element 411 is preferably embodied as a four-color printing element 411. As has already been described, the second drive motor 408 of the second central cylinder 401 is preferably connected to the machine controller in terms of circuitry such that the machine controller is informed at all times as to the rotational position of the second drive motor 408, and therefore likewise as to the rotational position of the second central cylinder 401, on the basis of target data about the rotational position of the second drive motor 408, provided by the machine controller to the second drive motor 408 of the second central cylinder 401. Ink droplets are then ejected from the at least one nozzle of the at least one print head 412 of the second printing unit 400 on the basis of the rotational position of the second drive motor 408 that is provided by the machine controller. In this case, the target data about the rotational position of the second drive motor 408, provided by the machine controller to the second drive motor 408, are preferably included in real time in a calculation of data for controlling the nozzles of the at least one print head 412. A comparison with actual data about the rotational position of the second drive motor 408 is preferably not necessary and preferably is not carried out.

The printing machine 01 preferably has at least one register sensor, which senses the position of at least one and preferably each first printed image applied by the at least one first printing element 211 onto the first side of the printing material web 02, and transmits this to the higher-level machine controller. A barcode can be used as the at least one printed image which is detected by the register sensor, for example, and is applied for this purpose to the printing material web 02 in the first printing unit 200. Such a barcode can contain information about the content and/or the dimensions of a printed image applied to the printing material web 02 by the first printing unit 200. This serves to ensure the maintenance of register, even if the cutting-off length, that is, the length of printed images that are applied in the direction of the transport path of the printing material web 02, is adjusted, for example. The higher-level machine controller uses the position of this printed image to calculate the ideal time period for controlling the nozzles of the print heads 412 of the at least one second printing element 411. A true-to-register alignment of the first printed image on the first side of the printing material web 02 and of the second printed image on the second side of the printing material web 02 is thereby achieved.

The at least one register sensor is preferably positioned closer to the second central cylinder 401 than to the first central cylinder 201, referred to the transport path of the printing material web 02. This allows the greatest possible number of factors to which the printing material web 02 is exposed along its transport path between the at least one first printing element 211 and the at least one second printing element 411, such as stretching of the printing material web 02 along the transport path, to be taken into consideration. The at least one register sensor is preferably embodied as at least one surface camera. Such a surface camera preferably has a high enough resolution capability that it can detect register errors and/or color registration errors, for example, a resolution capability of better than 0.05 mm. The at least one register sensor is preferably identical to the at least one first printed image sensor, which is used to monitor and control the actuation of all print heads 212 and/or double rows of print heads 212 of the first printing element 211, positioned and/or acting one in front of the other in the circumferential direction of the first central cylinder 201.

At least one second dryer 331 is situated downstream of the at least one second printing unit 400 with respect to the transport path of the printing material web 02. Once the printing material web 02 has passed through the at least one second printing unit 400, the printing material web 02 is transported further along its transport path and is fed to the at least one second dryer 331 of the at least one dryer unit 300. The at least one second dryer 331 is preferably structured similarly to the at least one first dryer 301. The at least one first dryer 301 and the at least one second dryer 331 are components of the at least one dryer unit 300. An area of action of the at least one first dryer 301 with respect to the printing material web 02 preferably points away from the at least one second dryer 331, and an area of action of the at least one second dryer 331 with respect to the printing material web 02 preferably points away from the at least one first dryer 301. More preferably, a section of the transport path of the printing material web 02 extends between the at least one first dryer 301 and the at least one second dryer 331.

The second side of the printing material web 02, which has been imprinted by the at least one second printing unit 400, is preferably not in contact with any component of the web-fed printing machine 01 between a last point of contact of the printing material web 02 with the second central cylinder 401 of the at least one second printing unit 400 and an area of action of the at least one second dryer 301. The first side of the printing material web 02, which has been imprinted by the first printing unit 200 and already dried, and is not imprinted by the second printing unit 400, and which is in contact with the second central cylinder 401 of the at least one second printing unit 400, is preferably in contact with at least one deflecting roller 414 of the at least one second printing unit 400 and/or with at least one deflecting roller 342 of the at least one second dryer 331 between the last point of contact of the printing material web 02 with the second central cylinder 401 of the at least one second printing unit 400 and the area of action of the at least one second dryer 331. At least one deflecting roller 414 of the second printing unit 400 is preferably provided, which deflects the printing material web 02, once said web has been released from the central cylinder 401 in a direction having a greater vertical, preferably downwardly oriented component than an optionally existing horizontal component into a direction having a greater horizontal component than an optionally existing vertical component. In this case, only the first side of the printing material web 02, which has not been imprinted by the second printing unit 400, is in contact with this at least one deflecting roller 414 of the second printing unit 400.

This at least one deflecting roller 414 is preferably embodied as a fifth measuring device 414, particularly a fifth measuring roller 414. This will be described in greater detail further below. At least one deflecting roller 342 of the at least one second dryer 331 is preferably provided, which deflects the printing material web 02 from this direction or from another direction having a greater horizontal component than an optionally existing vertical component into a direction having a greater vertical, preferably upwardly oriented component than an optionally existing horizontal component. In this case, only the first side of the printing material web 02 which has not been imprinted by the second printing unit 400 is in contact with the at least one deflecting roller 342 of the at least one second dryer 331.

The at least one second dryer 331 is also preferably embodied as an infrared radiation dryer 331. The structure of the at least one second dryer 331 is similar to the structure of the at least one first dryer 301, particularly in terms of an embodiment as an air flow dryer 331 and/or a radiation dryer 331 and/or a hot air dryer 331 and/or a UV radiation dryer 331. More particularly, the at least one second dryer 331 preferably has at least one second cooling roller 334, which further preferably represents at least one sixth motor-driven rotating body 334. The second cooling roller 334 is preferably driven and/or drivable by means of a second cooling roller drive 341. The at least one second dryer 331 is preferably structured as substantially and more preferably as fully symmetrical to the at least one first dryer 301 in terms of the described components. The at least one second dryer 331 likewise preferably has a ventilating device, which is embodied similarly to the ventilating device of the at least one first dryer 301 and/or is coupled therewith or identical thereto.

The at least one second dryer 331 is preferably part of the same dryer unit 300 as the at least one first dryer 301 and is more preferably located in the same housing 329. In terms of spatial arrangement, the dryer unit 300, and therefore preferably the at least one first dryer 301 and the at least one second dryer 331, is preferably positioned between the at least one first printing unit 200 and the at least one second printing unit 400. This means that a straight line connecting the rotational axis 207 of the at least one first central cylinder 201 of the at least one first printing unit 200 with a rotational axis 407 of the at least one second central cylinder 401 of the second printing unit 400 is preferably located intersecting with the at least one dryer unit 300.

At least one drawing roller 501 is located downstream of the at least one second dryer 331 along the transport path of the printing material web 02. The at least one drawing roller 501 has an integral drive motor 504 embodied as a drawing roller drive 504. The at least one drawing roller 504 preferably represents at least one seventh motor-driven rotating body 504. The at least one drawing roller 501, preferably together with a drawing impression roller 502 which is engaged and/or engageable against the at least one drawing roller 501, forms a drawing nip 503 in which the printing material web 02 is clamped and through which the printing material web 02 is conveyed. However, the at least one drawing roller 501 can also be embodied as a suction roller. The drawing impression roller 502 preferably has an outer surface made of a flexible material, for example, an elastomer. The drawing nip 503 preferably serves to adjust a web tension and/or a transport of the printing material web 02.

At least one rewetting unit is preferably located upstream and/or downstream of the drawing roller 501 with respect to the transport path of the printing material web 02, and compensates for excess moisture losses in the printing material web 02 as a result of treatment in the dryer unit 300. The at least one rewetting unit preferably has at least one first electrode, which preferably applies an electrical charge to the printing material web 02. The at least one rewetting unit preferably has at least one second electrode, the charge of which is opposite that of the at least one first electrode, and on which or in the immediate vicinity of which water is preferably released in the form of preferably charged water droplets and/or water vapor. The at least one first electrode and/or the charged printing material web 02 on one side and the at least one second electrode on the other side together form a capacitor, in the electrical field of which the preferably charged water droplets and/or the water vapor are moved to the printing material web 02 and upon reaching said web moisten it. This prevents the printing material web 02 from becoming unnecessarily brittle, particularly if it will be further processed.

At least one post-processing apparatus 500 is located downstream of the drawing nip 503 and/or downstream of the rewetting unit along the transport path of the printing material web 02, and is preferably embodied as a folding device 500 and/or has a sheet cutter 500 and/or a flat delivery unit 500, or is embodied as a winding device 500. In this and/or by this post-processing apparatus 500, the printing material web 02 is preferably folded and/or cut and/or stapled and/or sorted and/or packaged in envelopes and/or shipped and/or wound.

Figure 10:
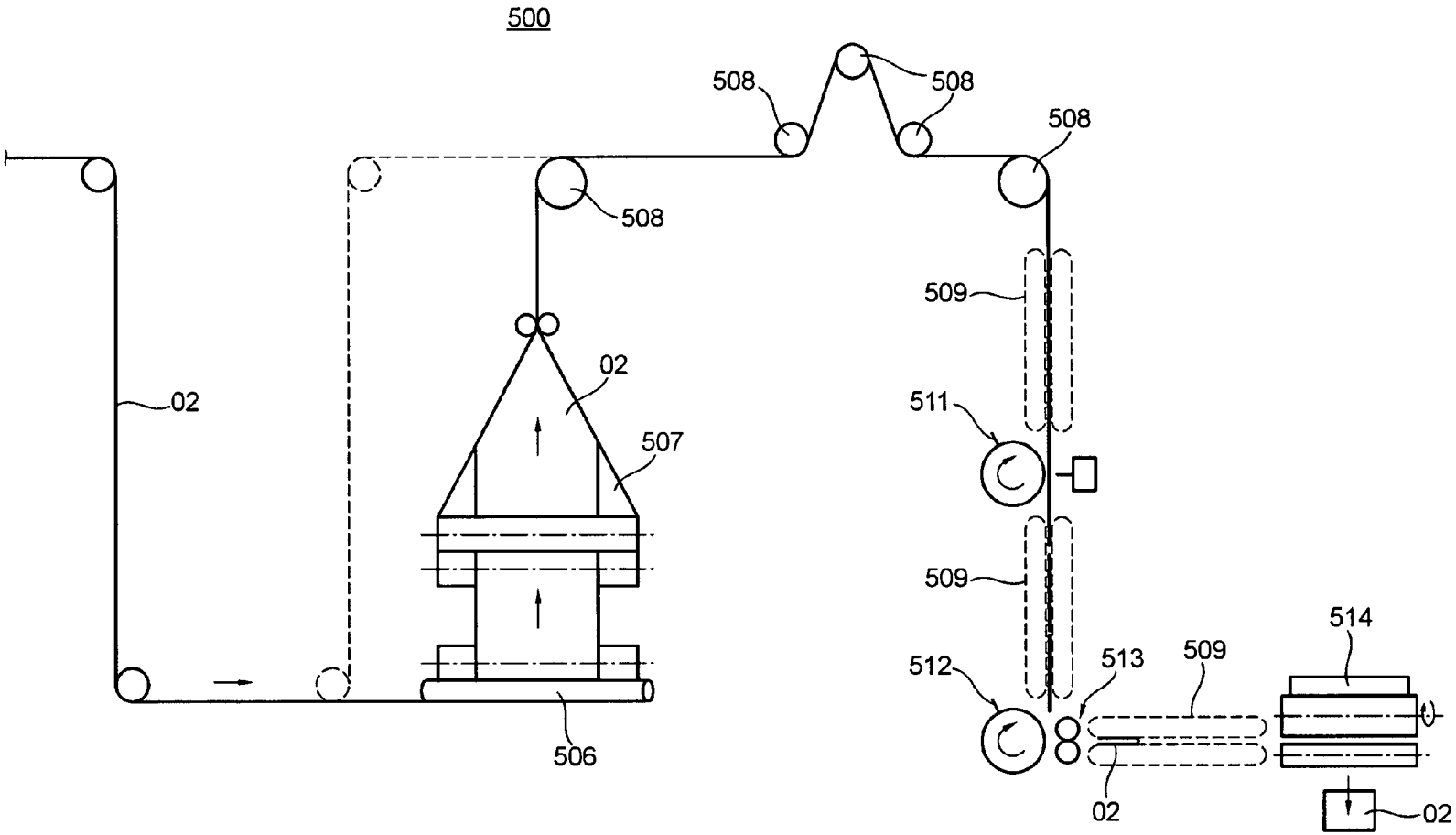
FIG. 10 a schematic illustration of a transport path of a printing material web in a post-processing apparatus.

A preferred post-processing apparatus 500 will be described by way of example. In the post-processing apparatus 500, the printing material web 02 is preferably guided around at least one turner bar 506 or guide roller 506, which is arranged oriented at an angle of 40° to 50° relative to a direction of transport of the printing material web 02. At least one fold former 507 is preferably provided, which preferably provides the printing material web 02 with a longitudinal fold, for example. Alternatively, the transport path of the printing material web 02 can also bypass the at least one fold former 507. (Such an alternative transport path is indicated by dashed lines in FIG. 10, by way of example.) The transport path of the printing material web 02 then preferably runs over at least one guide roller 508 and/or between at least one pair of transport belts 509. The printing material web 02 is preferably cut into sections by means of a cross-cutting unit 511, and these sections are provided with a first cross fold by means of a tucker blade 512 and a pair of fold rollers 513. The sections are then preferably alternatively provided with an optional second longitudinal fold by means of a further tucker blade 514, for example, a folding blade 514, and/or are stapled and/or cut to size. Additional or alternative post-processing steps are also conceivable. Printed products having optionally eight, twelve or sixteen pages, for example, can thereby be produced.

The transport path of the printing material web 02 through the printing machine 01 can be divided into multiple sections. A plurality of contact points between the printing material web 02 and motor-driven rotating bodies 103; 118; 201; 304; 401; 334; 501 are preferably located along the transport path of the printing material web 02 through the web-fed printing machine 01. In each case, two such contact points between the printing material web 02 and motor-driven rotating bodies 103; 118; 201; 304; 401; 334; 501 preferably delimit each section of the transport path of the printing material web 02 through the printing machine.

A first such contact point is preferably defined by the roll unwinding device 100, wherein the roll holding device 103 preferably represents the corresponding first motor-driven rotating body 103 and is driven by the drive motor 104 of the roll unwinding device 100. A second such contact point is preferably defined by the infeed nip 119, wherein the traction roller 118 preferably represents the corresponding second motor-driven rotating body 118 and is driven by the traction drive motor 146. A third such contact point is preferably defined by the at least one first central cylinder 201, wherein the at least one first central cylinder 201 preferably represents the corresponding third motor-driven rotating body 201 and is driven by the first drive motor 208 thereof. A fourth such contact point is preferably defined by the first cooling roller nip 309, wherein the first cooling roller 304 preferably represents the corresponding fourth motor-driven rotating body 304 and is driven by the first cooling roller drive motor 311. A fifth such contact point is preferably defined by the at least one second central cylinder 401, wherein the at least one second central cylinder 401 preferably represents the corresponding fifth motor-driven rotating body 401 and is driven by the drive motor 408 thereof. A sixth such contact point is preferably defined by the second cooling roller nip 339, wherein the second cooling roller 334 preferably represents the corresponding sixth motor-driven rotating body 334 and is driven by the drive motor 341 embodied as the second cooling roller drive motor 341. A seventh such contact point is preferably defined by the drawing nip 503, wherein the drawing roller 501 preferably represents the corresponding seventh motor-driven rotating body 501 and is driven by the drawing roller drive 504.

A first section of the transport path of the printing material web 02 preferably extends between the first contact point between the printing material web 02 and a motor-driven rotating body 103 and the second contact point between the printing material web 02 and a motor-driven rotating body 118. A second section of the transport path of the printing material web 02 preferably extends between the second contact point between the printing material web 02 and a motor-driven rotating body 118 and the third contact point between the printing material web 02 and a motor-driven rotating body 201. A third section of the transport path of the printing material web 02 preferably extends between the third contact point between the printing material web 02 and a motor-driven rotating body 201 and the fourth contact point between the printing material web 02 and a motor-driven rotating body 304. A fourth section of the transport path of the printing material web 02 preferably extends between the fourth contact point between the printing material web 02 and a motor-driven rotating body 304 and the fifth contact point between the printing material web 02 and a motor-driven rotating body 401. A fifth section of the transport path of the printing material web 02 preferably extends between the fifth contact point between the printing material web 02 and a motor-driven rotating body 401 and the sixth contact point between the printing material web 02 and a motor-driven rotating body 334. A sixth section of the transport path of the printing material web 02 preferably extends between the sixth contact point between the printing material web 02 and a motor-driven rotating body 334 and the seventh contact point between the printing material web 02 and a motor-driven rotating body 501. At least one measuring device 141; 216; 214; 416; 414; 343, more preferably a measuring roller 141; 216; 214; 416; 414; 343, is preferably dedicated to each section of the transport path of the printing material web 02. Each of these measuring devices 141; 216; 214; 416; 414; 343, particularly measuring rollers 141; 216; 214; 416; 414; 343, serves to detect the web tension in the corresponding section of the transport path of the printing material web 02 to which the respective measuring roller is dedicated.

The first section of the transport path preferably starts at the printing material roll 101, connected to the roll holding device 103, in the roll unwinding device 100, and preferably extends first over the dancer roller 113 and through the web edge aligner 114, and preferably around the first measuring roller 141, embodied as an infeed measuring roller 141, into the infeed nip 119. The web tension in this first section is preferably adjusted by adjusting the rotational speed of the at least one drive motor 104 of the roll holding device 103 such that the dancer lever 121 that supports the dancer roller 113 remains in a target position, for example, a central position. Alternatively or additionally, the web tension in this first section is adjusted by adjusting the rotational speed of the at least one drive motor 104 of the roll holding device 103 such that a value for web tension, measured by the first measuring device 141, preferably embodied as a first measuring roller 141, particularly as an infeed measuring roller 141, corresponds to a target value for web tension.

In the second section of the transport path, at least one second measuring device 216 is preferably arranged, which preferably serves to measure web tension in this second section. The second section of the transport path preferably starts at the infeed nip 119 and extends around at least one second measuring roller 216 of the first printing unit 200 and around the first deflecting roller 203, and at least partially around the at least one first central cylinder 201 and further preferably into the first impression roller nip 209 of the at least one first printing unit 200. The transport path, starting from the infeed nip 119 and preferably extending around at least the second measuring roller 216 of the first printing unit 200, preferably extends first with a greater horizontal component than an optionally existing vertical component to beyond the at least one first printing unit 200, and then with a greater vertical, downwardly oriented component than an optionally existing horizontal component, to a height that is below the at least one first central cylinder 201, and then with a greater horizontal component than an optionally existing vertical component below the rotational axis 207 of the at least one first central cylinder 201, and then around the first deflecting roller 203 on the outer cylinder surface of the at least one first central cylinder 201, and preferably into the first impression roller nip 209.

Alternatively, the second measuring device 216 can also be positioned further upstream along the transport path. In that case, the transport path, starting from the infeed nip 119, extends first with a greater horizontal component than an optionally existing vertical component beyond the at least one first printing unit 200, and then with a greater vertical, downwardly oriented component than an optionally existing horizontal component to a height that is below the at least one first central cylinder 201, and then with a greater horizontal component than an optionally existing vertical component, below the rotational axis 207 of the at least one first central cylinder 201, and then around the second measuring roller 216 and around the first deflecting roller 203 onto the outer cylinder surface of the at least one first central cylinder 201, and preferably into the first impression roller nip 209.

In a first, preferred variant, the web tension in this second section is adjusted in that the web tension is measured by means of the second measuring device 216, particularly the second measuring roller 216, and a rotational speed of the traction roller 118 is adjusted by means of the traction drive motor 146 such that the web tension at the second measuring device 216, particularly the second measuring roller 216, takes on a predefined value. In a second variant, the web tension in this second section is adjusted in that the web tension is measured by means of the second measuring device 216, particularly the second measuring roller 216, and the rotational speed of the first central cylinder 201 is adjusted by means of the drive motor 208 thereof, such that the web tension at the second measuring device 216, particularly the second measuring roller 216, takes on the predefined value.

In the third section of the transport path, at least one third measuring device 214 is preferably provided, which preferably serves to measure the web tension in this third section. This third measuring device 214 is preferably embodied as a third measuring roller 214. The third section of the transport path preferably starts at the at least one first central cylinder 201 and/or the first impression roller nip 209 and extends through the at least one first dryer 301 up to the first cooling roller nip 309. The transport path preferably extends, starting from the at least one first central cylinder 201 and/or the first impression roller nip 209, through the at least one first printing element 211 and around the at least one deflecting roller 214, embodied as a third measuring roller 214, of the first printing unit 200, around the at least one deflecting roller 312 of the at least one first dryer 301 and through the at least one first dryer 301, and around the first deflecting roller 307 of the first cooling unit 303, and around the first cooling roller 304 up to the first cooling roller nip 309. In a first, preferred variant, the web tension in this third section is adjusted in that the web tension is measured by means of the third measuring device 214, particularly the third measuring roller 214, and the rotational speed of the at least one first central cylinder 201 is adjusted by means of the drive motor 208 thereof such that the web tension at the third measuring device 214, particularly the third measuring roller 214, takes on a predefined value. In a second variant, the web tension in this third section is adjusted in that the web tension is measured by means of the third measuring device 214, particularly the third measuring roller 214, and the rotational speed of the first cooling roller 303 is adjusted by means of the first cooling roller drive motor 311 thereof such that the web tension at the third measuring device 214, particularly the third measuring roller 214, takes on a predefined value.

In the fourth section of the transport path, at least one fourth measuring device 416 is preferably provided, which preferably serves to measure the web tension in this fourth section. This fourth measuring device 416 is preferably embodied as a fourth measuring roller 416. The fourth section of the transport path preferably starts at the first cooling roller nip 309 and extends around the at least one fourth measuring roller 416 and around the second deflecting roller 403, at least partially around the second central cylinder 401, and preferably into the second impression roller nip 409 of the at least one second printing unit 400. The transport path, starting from the first cooing roller nip 309, preferably extends first with a greater horizontal component than an optionally existing vertical component over the at least one first dryer 301 past the at least one second dryer 331, then with a greater, downwardly oriented vertical component than an optionally existing horizontal component, to a height that is below the second central cylinder 401, and then with a greater horizontal component than an optionally existing vertical component, below the rotational axis 407 of the second central cylinder 401, then around the fourth measuring roller 416 and around the second deflecting roller 403 onto the outer cylinder surface of the second central cylinder 401, and preferably into the second impression roller nip 409. In a first, preferred variant, the web tension in this fourth section is adjusted in that the web tension is measured by means of the fourth measuring device 416, particularly the fourth measuring roller 416, and the rotational speed of the first cooling roller 303 is adjusted by means of the first cooling roller drive motor 311 thereof such that the web tension at the fourth measuring device 416, particularly the fourth measuring roller 416, takes on a predefined value. In a second variant, the web tension in this fourth section is preferably adjusted in that the web tension is measured by means of the fourth measuring device 416, particularly the fourth measuring roller 416, and the rotational speed of the second central cylinder 401 is adjusted by means of the drive motor 408 thereof such that the web tension at the fourth measuring device 416, particularly the fourth measuring roller 416, takes on a predefined value.

In the fifth section of the transport path, at least one fifth measuring device 414 is preferably provided, which preferably serves to measure the web tension in this fifth section. This fifth measuring device 414 is preferably embodied as a fifth measuring roller 414. The fifth section of the transport path preferably starts at the at least one second central cylinder 401 and/or the second impression roller nip 409 and extends through the at least one second dryer 331 and into the second cooling roller nip 339. The transport path preferably extends, starting from the at least one second central cylinder 401 and/or the second impression roller nip 409, through the at least one second printing element 411 and around the at least one deflecting roller 414, embodied as a fifth measuring roller 414, of the second printing unit 400, around the at least one deflecting roller 342 of the at least one second dryer 331 and through the at least one second dryer 331, around a third deflecting roller 337 of a second cooling unit 333 and around a second cooling roller 334 into the second cooling roller nip 339, which is formed by the second cooling roller 334 and the second cooling impression roller 336. The second cooling roller 334 preferably has the integral second cooling roller drive motor 341. In a first, preferred variant, the web tension in this fifth section is adjusted in that the web tension is measured by means of the fifth measuring device 414, particularly the fifth measuring roller 414, and a rotational speed of the second central cylinder 401 is adjusted by means of the drive motor 408 thereof such that the web tension at the fifth measuring device 414, particularly the fifth measuring roller 414, takes on a predefined value. In a second variant, the web tension in this fifth section is adjusted in that the web tension is measured by means of the fifth measuring device 414, particularly the fifth measuring roller 414, and the rotational speed of the second cooling roller 334 is adjusted by means of the second cooling roller drive motor 341 thereof such that the web tension at the fifth measuring device 414, particularly the fifth measuring roller 414, takes on a predefined value.

In the sixth section of the transport path, at least one sixth measuring device 343 is preferably provided, which preferably serves to measure the web tension in this sixth section. This sixth measuring device 343 is preferably embodied as a sixth measuring roller 343. The sixth section of the transport path starts at the second cooling roller nip 339 and extends between the at least one first dryer 301 and the at least one second dryer 331, and around at least one sixth measuring roller 343, through the drawing nip 503. In a first, preferred variant, the web tension in this sixth section is adjusted in that the web tension is measured by means of the sixth measuring device 343, particularly the sixth measuring roller 343, and the rotational speed of the second cooling roller 334 is adjusted by means of the second cooling roller drive motor 341 thereof such that the web tension at the sixth measuring device 343, particularly the sixth measuring roller 343, takes on a predefined value. In a second variant, the web tension in this sixth section is adjusted in that the web tension is measured by means of the sixth measuring device 343, particularly the sixth measuring roller 343, and the rotational speed of the drawing roller 501 is adjusted by means of the drawing roller drive 504 thereof such that the web tension at the sixth measuring device 343, particularly the sixth measuring roller 343, remains constant.

All the measuring devices 141; 216; 214; 416; 414; 343, particularly measuring rollers 141; 216; 214; 416; 414; 343 and/or other measuring devices that measure web tension, and all drive motors 104; 146; 208; 311; 408; 341; 504 are preferably connected to the higher-level machine controller, more preferably to an electronic guiding axis. The higher-level machine controller preferably influences multiple and more preferably all the drive motors 104; 146; 208; 311; 408; 341; 504 of motor-driven rotating bodies 103; 118; 201; 304; 401; 334; 501, upstream and/or downstream with respect to the transport path of the printing material web 02, as soon as at least one such drive motor 104; 146; 208; 311; 408; 341; 504 is influenced on the basis of a measurement of web tension. This results in a particularly rapid adjustment to changes in web tension along the entire transport path of the printing material web 02. In another variant, web tension is adjusted separately in each of the individual sections. This results indirectly in changes in web tension in adjoining sections, which are then likewise automatically compensated for. At least one drive motor 104; 146; 208; 311; 408; 341; 504 and preferably precisely one drive motor 104; 146; 208; 311; 408; 341; 504 of a motor-driven rotating body 103; 118; 201; 304; 401; 334; 501 is preferably embodied as a guiding drive motor 104; 146; 208; 311; 408; 341; 504. A rotational speed of the guiding drive motor 104; 146; 208; 311; 408; 341; 504 is preferably predefined, more preferably independently of measurements by the measuring rollers 141; 216; 214; 416; 414; 343. Further preferable is the drawing roller drive 504 of the guiding drive motor 504.

This therefore results in the printing machine 01, which comprises the at least one first printing unit 200, which has the at least one inkjet print head 212, the at least one first central printing cylinder 201 and the integral first drive motor 208, dedicated to the at least one first central printing cylinder 201, wherein the transport path of the printing material web 02 through the printing machine 01 has at least the first and the second section, each of which is delimited by contact points of the printing material web 02 with the motor-driven rotating bodies 103; 118; 201; 304; 401; 334; 501, and wherein the at least one first measuring device 141; 216; 214; 416; 414; 343 for measuring the web tension of the printing material web 02 in the first section is dedicated at least to the first section, and wherein the at least one second measuring device 141; 216; 214; 416; 414; 343 for measuring the web tension of the printing material web 02 in the second section is dedicated at least to the second section, and wherein the machine controller is provided, by means of which the web tension at least in the first section and/or in the second section of the transport path of the printing material web 02 can be and/or is adjusted, taking into consideration at least both at least one measured value from the at least one first measuring device 141; 216; 214; 416; 414; 343 and at least one measured value from the at least one second measuring device 141; 216; 214; 416; 414; 343.

The first drive motor 208, dedicated to the at least one first central printing cylinder 201, is preferably adjustable and/or adjusted by the machine controller. The at least one inkjet print head 212 is preferably controllable and/or controlled and/or adjustable and/or adjusted by means of the machine controller. The at least one inkjet print head 212 is preferably controllable and/or controlled and/or adjustable and/or adjusted by means of the machine controller on the basis at least of a rotational angle position of the at least one central printing cylinder 201. At least one of these sections is preferably delimited by the at least one first central printing cylinder 201.

At least one second printing unit 400 is preferably positioned downstream of the at least one first printing unit 200 along the transport path of the printing material web 02 through the printing machine 01, and the at least one second printing unit 400 has the at least one second central printing cylinder 401 and the second drive motor 408, assigned to the at least one second central printing cylinder 401. The at least one first dryer 301, followed by the at least one second printing unit 400, followed by the at least one second dryer 331 are preferably arranged downstream of the at least one first printing unit 200 along the transport path of the printing material web 02 through the printing machine 01. The second printing unit 400 preferably comprises the at least one inkjet print head 412, which is more preferably aligned toward the outer surface of the second central printing cylinder 401 or at least one transfer element, for example, at least one transfer cylinder and/or at least one transfer belt of the second printing unit 400, said print head being controllable and/or controlled and/or adjustable and/or adjusted by means of the machine controller. The at least one inkjet print head 412 of the second printing unit 400 is preferably controllable and/or controlled and/or adjustable and/or adjusted by means of the machine controller on the basis at least of the rotational angle position and/or rotational speed of the at least one first central printing cylinder 201 and/or the rotational angle position and/or rotational speed of the at least one second central printing cylinder 401. More particularly, when the web tension changes in at least one section of the transport path which lies between the first central printing cylinder 201 and the second central printing cylinder 401, a change in the phase position of the at least one first central printing cylinder 201 and the at least one second central printing cylinder 401 occurs, since the printing material is stretched or relaxed and therefore shortened, while the transport path remains the same.

Each section of the transport path of the printing material web 02 is preferably delimited at least at one end and more preferably at both ends by a motor-driven rotating body 103; 118; 201; 304; 401; 334; 501, the drive motor 104; 146; 208; 311; 408; 341; 504 of which is adjustable and/or adjusted by means of the machine controller. At least one and preferably precisely one motor-driven rotating body 103; 118; 201; 304; 401; 334; 501, which is positioned delimiting at least one section of the transport path of the printing material web 02, is preferably adjustable and/or adjusted by the machine controller, independently of measurements from the measuring devices 141; 216; 214; 416; 414; 343 for measuring the web tension of the printing material web 02. At least one section of the transport path of the printing material web 02 is preferably delimited by the motor-driven rotating body 501 embodied as drawing roller 501, which is positioned downstream of a second central printing cylinder 401 of a second printing unit 400 with respect to the transport path. More preferably, this motor-driven rotating body 501, embodied as drawing roller 501, is preferably adjustable and/or adjusted by the machine controller, independently of measurements from the measuring devices 141; 216; 214; 416; 414; 343 for measuring the web tension of the printing material web 02. A printing speed of the printing machine is particularly defined thereby.

At least one additional motor-driven rotating body 304 is preferably positioned along the transport path of the printing material web 02 between the at least one first central printing cylinder 201 and the at least one second central printing cylinder 401, in contact with the printing material web 02.

The web tension in at least one section of the transport path of the printing material web 02 is preferably adjustable and/or adjusted on the basis of at least one rotational speed and/or at least one angular position of at least one rotating body 103; 118; 201; 304; 401; 334; 501 that delimits this section, the drive motor 104; 146; 208; 311; 341; 408; 504 of said rotating body being adjustable and/or adjusted by means of the machine controller.

Preferably, the at least one first measuring device 141; 216; 214; 416; 414; 343 is embodied as at least one first measuring roller 141; 216; 214; 416; 414; 343, and/or the at least one second measuring device 141; 216; 214; 416; 414; 343 is embodied as at least one second measuring roller 141; 216; 214; 416; 414; 343. Further preferably, the at least one first measuring roller 141; 216; 214; 416; 414; 343 and/or the at least one second measuring roller 141; 216; 214; 416; 414; 343 are mounted in at least one bearing, which has a dynamometer which can be used to measure a force preferably acting orthogonally to a rotational axis of the respective measuring roller 141; 216; 214; 416; 414; 343. The at least one first measuring roller 141; 216; 214; 416; 414; 343 is preferably embodied as a passively rotatable and/or rotating measuring roller 141; 216; 214; 416; 414; 343 without an integral rotational drive, and/or the at least one second measuring roller 141; 216; 214; 416; 414; 343 is preferably embodied as a passively rotatable and/or rotating measuring roller 141; 216; 214; 416; 414; 343 without an integral rotational drive, and/or each measuring roller 141; 216; 214; 416; 414; 343 is preferably embodied as a passively rotatable measuring roller 141; 216; 214; 416; 414; 343 without an integral rotational drive.

The at least one first section and the at least one second section of the transport path of the printing material web 02 are preferably each delimited with respect to at least one end by a nip, which is formed by at least one motor-driven rotating body 103; 118; 201; 304; 401; 334; 501 and a traction impression roller 117 and/or impression roller 206, 406 and/or cooling impression roller 306; 336 and/or drawing impression roller 502, engaged against said rotating body.

Each section of the transport path of the printing material web 02 through the printing machine 01 that is upstream of a last central printing cylinder 201; 401 and more preferably upstream of a drawing roller 501 of the printing machine 01 with respect to the transport path of the printing material web 02 has assigned to it at least one measuring device 141; 216; 214; 416; 414; 343 for measuring the web tension of the printing material web 02 in that section, and the web tension in at least one of these sections, and more preferably in each of these sections of the transport path of the printing material web 02 through the printing machine 01 is adjustable and/or adjusted by means of the machine controller, taking into consideration at least the measured values for the web tensions in all of these sections of the transport path of the printing material web 02 through the printing machine 01.

The at least one first measuring device 141; 216; 214; 416; 414; 343 and/or the at least one second measuring device 141; 216; 214; 416; 414; 343 are preferably different from the motor-driven rotating bodies 103; 118; 201; 304; 401; 334; 501 that delimit the sections of the transport path of the printing material web 02.

The machine controller preferably has access to data about the lengths of at least the first section and the second section, and more preferably of all sections of the transport path of the printing material web 02 through the printing machine and/or to data about the material properties of the printing material web 02, for example, a modulus of elasticity. Further preferably, these data are stored in a data storage device and are accessed for adjusting web tension.

In one variant of the printing machine, the printing machine 01 is embodied as a web-fed rotary inkjet printing machine 01, and at least one transfer element is arranged so as to form a transfer nip with the at least one first central printing cylinder 201. In that case, the at least one print head 212 is preferably aligned toward the at least one transfer element.

This results in a method for adjusting the web tension of the printing material web 02 along the transport path through the web-fed printing machine 01, wherein the printing machine 01 comprises the at least one first printing unit 200, and wherein the at least one central printing cylinder 201 of the at least one first printing unit 200 is driven by means of the integral drive motor 208 that is dedicated to the at least one first central printing cylinder 201, and wherein printing ink that is ejected by the at least one inkjet print head 212 of the at least one first printing unit 200 is transferred and/or transferable to the printing material web 02, and wherein the transport path of the printing material web 02 has at least the first section and the second section, each of which is delimited by contact points of the printing material web 02 with motor-driven rotating bodies 103; 118; 201, and wherein the web tension of the printing material web 02 in the first section is measured by means of at least one first measuring device 141; 216; 214; 416; 414; 343, and wherein the web tension of the printing material web 02 in the second section is measured by means of at least one second measuring device 141; 216; 214; 416; 414; 343, and wherein the machine controller uses at least one measured value from the at least one first measuring device 141; 216; 214; 416; 414; 343 and at least one measured value from the at least one second measuring device 141; 216; 214; 416; 414; 343 in order to adjust the web tension of the printing material web 02 at least in the first section and/or in the second section of the transport path of the printing material web 02.

The rotational speed of the drive motor 208 assigned to the at least one first central printing cylinder 201 is preferably adjusted by the machine controller.

The at least one inkjet print head 212 of the first printing unit 200 is preferably controlled by means of the machine controller, particularly on the basis at least of the rotational angle position of the at least one first central printing cylinder 201, and/or the at least one inkjet print head 212 of the first printing unit 200 is controllable by means of the machine controller, particularly on the basis at least of a rotational angle position of the at least one first central printing cylinder 201. The at least one inkjet print head 412 of the second printing unit 400 is also preferably controlled by means of the machine controller, and/or the at least one inkjet print head 412 of the second printing unit 400 is also controllable by means of the machine controller. Even more preferably, the at least one inkjet print head 412 of the second printing unit 400 is controlled by means of the machine controller on the basis at least of a rotational angle position and/or a rotational speed of the at least one first central printing cylinder 201 and/or at least a rotational angle position and/or a rotational speed of the at least one second central printing cylinder 401, and/or the at least one inkjet print head 412 of the second printing unit 400 is controllable by means of the machine controller on the basis at least of a rotational angle position and/or a rotational speed of the at least one first central printing cylinder 201 and/or at least a rotational angle position and/or a rotational speed of the at least one second central printing cylinder 401.

In one variant of the printing method, the at least one inkjet print head 412 of the second printing unit 400 is aligned toward a transfer surface of a second central printing cylinder 401 or at least of a transfer element, for example, at least one transfer cylinder and/or at least one transfer belt of the second printing unit 400. The method is then more preferably characterized in that the printing machine 01 is embodied as a web-fed rotary inkjet printing machine 01, and in that the at least one transfer element is arranged so as to form a transfer nip with the at least one first central printing cylinder 201, and in that printing ink ejected by the at least one inkjet print head 212 is transferred to the at least one transfer element, before being transferred later to the printing material web 02 which is in contact with the at least one central printing cylinder 201.

The method is preferably characterized in that each section of the transport path of the printing material web 02 is delimited at least at one end and more preferably at both ends by one, or by one in each case, motor-driven rotational element 103; 118; 201; 304; 401; 334; 501, the drive motor 104; 146; 208; 311; 408; 341; 504 of which is adjustable by means of the machine controller and/or is adjusted by means of the machine controller.

The method is preferably characterized in that each section of the transport path of the printing material web 02 through the printing machine 01 that is situated upstream of the last central printing cylinder 201; 401, particularly the drawing roller 501, of the printing machine 01 with respect to the transport path of the printing material web 02, has at least one dedicated measuring device 141; 216; 214; 416; 414; 343 for measuring the web tension of the printing material web 02 in that section, and in that the web tension in at least one and preferably in a plurality of these sections of the transport path of the printing material web 02 through the printing machine 01 is adjustable and/or adjusted by means of the machine controller, taking into consideration at least the measured values for web tension in all of these sections of the transport path of the printing material web 02 through the printing machine 01.

Further preferably, the method is characterized in that each section of the transport path of the printing material web 02 through the printing machine 01 that is situated upstream of the last central printing cylinder 201; 401, particularly the drawing roller 501, of the printing machine 01 with respect to the transport path of the printing material web 02 has at least one dedicated measuring device 141; 216; 214; 416; 414; 343 for measuring the web tension of the printing material web 02 in that section, and in that the web tension in each of these sections of the transport path of the printing material web 02 through the printing machine 01 is adjustable and/or adjusted by means of the machine controller, taking into consideration at least the measured values for web tension in all of these sections of the transport path of the printing material web 02 through the printing machine 01.

The method is preferably characterized in that, in order to adjust web tension, a rotational angle position and/or a rotational speed of the at least one first central printing cylinder 201 and/or a rotational angle position and/or a rotational speed of the at least one second central printing cylinder 401 is or are derived from target values, which are specified by the machine controller to the at least one first drive motor 208 of the at least one first central printing cylinder 201 and/or to the at least one second drive motor 408 of the at least one second central printing cylinder 401.

The method is preferably characterized in that the at least one print head 212 of the at least one first printing unit 200 is aligned toward an outer surface of the at least one first central printing cylinder 201 or at least one transfer element, for example, at least one transfer cylinder and/or at least one transfer belt, and/or in that the at least one print head 412 of the at least one second printing unit 400 is aligned toward the outer surface of the at least one second central printing cylinder 401 or at least one transfer element, for example, at least one transfer cylinder and/or at least one transfer belt.

In a simplified variant of the printing machine 01, the first cooling roller nip 309 and/or the second cooling roller nip 339 are dispensed with, so that the stated third section and the stated fourth section form a combined section, and/or the stated fifth section and the stated sixth section form a combined section. Additionally and/or alternatively, in this or another simplified variant, the first and/or the second impression roller 206; 406 are dispensed with. This is possible, for example, when it is otherwise ensured that no slip will occur between the printing material web 02 and a central cylinder 201; 401, for example, due to adequate friction.

It is noted that a motor-driven rotating body is understood particularly as a rotating body which is connected to a motor that drives it or to an interconnected torque transfer element, independently of contact with the printing material 02.

The printing ink is preferably a water-based printing ink, particularly a dispersion printing ink. In one variant, a varnish, preferably a dispersion varnish, is ejected from at least one print head. This print head is one of the already described print heads 212; 412 of the first printing unit 200 or the second printing unit 400, for example. Alternatively or additionally, at least one additional printing unit, particularly a varnishing unit, is provided, which preferably has at least one additional print head. Such a varnish is preferably a water-based varnish, for example, a dispersion varnish. In an alternative variant, a varnishing unit is provided, which transfers or is capable of transferring varnish onto the printing material 02 by rolling contact between the printing material 02 and a varnish application roller.

During printing operation, the transport speed of the printing material web 02 is preferably adjusted, while operation of the at least one print head 212 is continued, and particularly printing ink is ejected. This is particularly the case at the start of printing, and preferably also at least before a specified transport speed of the printing material web 02 is reached. The at least one print head 212 preferably ejects printing ink at all transport speeds of the printing material web 02 other than zero. The at least one print head 212 preferably ejects printing ink at all accelerations of the transport speed of the printing material web 02, particularly negative and/or positive accelerations. This is not only relevant within the framework of adjusting web tension, but also enables the production of useful printed products from the very start of a printing operation. This allows a savings in terms of time and material, because less paper spoilage and/or less unprinted printing material 02 is produced.

The invention claimed is:

1. A printing machine comprising:

a first printing unit including at least one inkjet print head, at least one central printing cylinder and an integral first drive motor dedicated to the at least one central printing cylinder;

a transport path of a printing material web through the printing machine, the transport path having a first section and a second section, each of the first section and the second section being delimited by contact points of the printing material web with a plurality of motor-driven rotating bodies;

a first dedicated measuring device in the first section for measuring a first web tension of the printing material web in the first section;

a second dedicated measuring device in the second section for measuring a second web tension of the printing material web in the second section; and a machine controller which is configured to adjust the web tension in the first section of the transport path of the printing material web by taking into consideration both of the first web tension measured value from the first dedicated measuring device and the second web tension measured value from the second dedicated measuring device and to adjust the web tension in the second section of the transport path of the printing material web by taking into consideration both of the first web tension measured value from the first dedicated measuring device and the second web tension measured value from the second dedicated measuring device.

2. The printing machine according to claim 1, characterized in that the integral first drive motor dedicated to the at least one central printing cylinder is one of adjustable and adjusted by the machine controller.

3. The printing machine according to claim 1, characterized in that the at least one inkjet print head is one of controllable and controlled by the machine controller on the basis of at least a rotational angle position of the at least one central printing cylinder.

4. The printing machine according to claim 1, characterized in that at least one of the first section and the second section is delimited by the at least one central printing cylinder.

5. A method for adjusting a web tension of a printing material web along a transport path through a printing machine including:

providing the printing machine having a first printing unit;

providing at least one central printing cylinder of the first printing unit and driving the at least one central printing cylinder using an integral drive motor which is dedicated to the at least one first central printing cylinder;

providing at least one ink jet print head in the first printing unit and ejecting printing ink from the at least one inkjet print head of the at least one first printing unit onto the printing material web;

providing at least a first section and at least a second section in a transport path of the printing material web, each of which first and second sections being delimited by contact points of the printing material web with a plurality of motor-driven rotating bodies;

monitoring a web tension of the printing material web in the first section using a first dedicated measuring device;

monitoring a web tension of the printing material web in the second section using a second dedicated measuring device;

providing a machine controller; and using a first web tension measured value from the first dedicated measuring device and a second web tension measured value from the second dedicated measuring device in the machine controller for adjusting the web tension of the printing material web in the first section of the transport path of the printing material web, and using the first web tension measured value from the first dedicated measuring device and the second web tension measured value from the second dedicated measuring device in the machine controller for adjusting the web tension of the printing material web in the second section of the transport path of the printing material web.

6. The method according to claim 5, further including adjusting a rotational speed of the integral drive motor dedicated to the at least one central printing cylinder using the machine controller.

7. The method according to claim 5, further including controlling the at least one inkjet print head using the machine controller on the basis at least of a rotational angle position of the at least one central printing cylinder.

8. The method according to claim 5, further including delimiting at least one of the first section and the second section by the at least one central printing cylinder.

* * * * *